US005532060A

United States Patent [19]

Aneja et al.

[11] Patent Number: 5,532,060

[45] **Date of Patent: * Jul. 2, 1996**

[54] CONTINUOUS HOLLOW FILAMENTS, YARNS, AND TOWS

[75] Inventors: Arun P. Aneja, Greenville; James H. Drew, Goldsboro, both of N.C.; Benjamin H. Knox, Wilmington, Del.

[73] Assignee: E. I. Du Pont de Nemours and Company, Wilmington, Del.

[ * ] Notice: The portion of the term of this patent subsequent to Mar. 1, 2015, has been disclaimed.

[21] Appl. No.: 289,553

[22] Filed: Aug. 12, 1994

Related U.S. Application Data

[60] Division of Ser. No. 979,776, Nov. 9, 1992, Pat. No. 5,356,582, which is a continuation-in-part of Ser. No. 753, 529, Sep. 3, 1991, Pat. No. 5,229,060, Ser. No. 753,769, Sep. 3, 1991, Pat. No. 5,261,472, Ser. No. 786,582, Nov. 1, 1991, Pat. No. 5,244,616, Ser. No. 786,583, Nov. 1, 1991, Pat. No. 5,145,623, Ser. No. 786,584, Nov. 1, 1991, Pat. No. 5,223, 197, Ser. No. 786,585, Nov. 1, 1991, Pat. No. 5,223,198, Ser. No. 925,042, Aug. 5, 1992, abandoned, Ser. No. 925,041, Aug. 5, 1992, abandoned, and Ser. No. 926,538, Aug. 5, 1992, Pat. No. 5,219,736, said Ser. No. 786,582, Ser. No. 786,583, Ser. No. 786,584, and Ser. No. 786,585, each is a continuation-in-part of Ser. No.338,251, Apr. 14, 1989, Pat. No. 5,066,447, which is a continuation-in-part of Ser. No. 53,309, May 22, 1987, abandoned, which is a continuation-in-part of Ser. No. 824,363, Jan. 30, 1986, abandoned, said Ser. No. 925,042, Ser. No. 925,041, and Ser. No. 926,538, each is a continuation-in-part of Ser. No.647,381, Jan. 29, 1991, abandoned, and Ser. No. 860,776, Mar. 27, 1992, abandoned, which is a continuation-in-part of Ser. No. 647,371, Jan. 29, 1991, abandoned.

[51] Int. Cl.[6] ..... D02G 3/00

[52] U.S. Cl. ..... 428/398; 428/364; 428/376; 428/395; 428/397; 57/243; 57/246; 57/247

[58] Field of Search ..... 428/364, 395, 428/397, 398; 264/209.1, 211.12

[56] References Cited

U.S. PATENT DOCUMENTS

| | | | |
|---|---|---|---|
| 3,771,307 | 11/1973 | Petrille | 57/157 |
| 3,772,872 | 11/1973 | Piazza et al. | 57/140 R |
| 4,129,675 | 12/1978 | Scott | 428/398 |
| 4,134,882 | 1/1979 | Frankfort et al. | 528/309 |
| 4,156,071 | 5/1979 | Knox | 528/272 |
| 4,195,051 | 3/1980 | Frankfort et al. | 264/176 F |
| 4,336,307 | 6/1982 | Shiozaki et al. | 428/398 |
| 4,361,617 | 11/1982 | Suzuki et al. | 428/224 |
| 4,391,872 | 7/1983 | Suzuki et al. | 428/224 |
| 5,033,523 | 7/1991 | Buyalos et al. | 428/364 |
| 5,104,725 | 4/1992 | Broaddus | 428/224 |
| 5,190,821 | 3/1993 | Goodall et al. | 428/398 |
| 5,223,198 | 6/1993 | Frankfort et al. | 264/103 |
| 5,230,957 | 7/1993 | Lin | 428/398 |
| 5,250,245 | 10/1993 | Collins et al. | 264/103 |
| 5,279,897 | 1/1994 | Goodal et al. | 428/398 |
| 5,362,563 | 11/1994 | Lin | 428/398 |

FOREIGN PATENT DOCUMENTS

| | | | |
|---|---|---|---|
| 3011118 | 10/1981 | Germany | 264/177.14 |

*Primary Examiner*—Patrick J. Ryan
*Assistant Examiner*—J. M. Gray

[57] ABSTRACT

Hollow polyester undrawn filaments having excellent mechanical quality and uniformity are prepared by a simplified post-coalescence melt spinning process at speeds of e.g. 2–5 km/min by selection of polymer and spinning conditions whereby the void content of the undrawn filaments can be essentially maintained or even increased when drawn cold or hot, with or without post heat-treatment.

11 Claims, 13 Drawing Sheets

COLD CRYSTALLIZATION TEMPERATURE (Tcc),°C
150
140
130
120
110
100
90
80
a
b
c
d
0
.02
.04
.06
.08
AMORPHOUS BIREFRINGENCE (△a)

POST YIELD SECANT MODULUS (Tan β),g/d
12
10
8
6
4
2
0
Tan β < Tan α
Tan β = Tan α
0
.020
.040
.060
.080
.100
.120
.140
BIREFRINGENCE (△n)

CONTINUOUS HOLLOW FILAMENTS, YARNS, AND TOWS

CROSS-REFERENCE TO RELATED APPLICATIONS

This is a division of application Ser. No. 07/979,776, filed Nov. 9, 1992, a continuation-in-part of applications 07/753,529 and 07/753,769, both filed by Knox et al, Sep. 3, 1991, and now, respectively, U.S. Pat. Nos. 5,229,060 and 5,261,472 and of the following four applications, that were all filed Nov. 1, 1991, 07/786582, filed by Hendrix et al, and now U.S. Pat. No. 5,244,616, 07/786,583, filed by Hendrix et al, and now U.S. Pat. No. 5,145,623, 07/786,584, filed by Boles et al now U.S. Pat. No. 5,223,197, and 07/786,585, filed by Frankfort et al now U.S. Pat. No. 5,223,198, all filed as continuations-in-part of application Ser. No. 07/338,251, filed Apr. 14, 1989, now U.S. Pat. No. 5,066,447, and which is sometimes referred to herein as the "parent application" being itself a continuation-in-part of abandoned application Ser. No. 07/053,309, filed May 22, 1987, itself a continuation-in-part of abandoned application Ser. No. 06/824,363, filed Jan. 30, 1986; and is also a continuation-in-part of abandoned application Ser. Nos. 07/925,042, filed by Aneja et al, and 07/925,041 and 07/926,538, now U.S. Pat. No. 5,219,736, filed by Bennie et al, all three filed Aug. 5, 1992 as continuations-in-part of abandoned application 07/647,381, filed by Collins et al, Jan. 29, 1991, and of abandoned application Ser. No. 07/860,776, filed by Collins et al, Mar. 27, 1992, as a continuation-in-part of abandoned application Ser. No. 07/647,371, also filed Jan. 29, 1991.

TECHNICAL FIELD

This invention concerns improvements in and relating to polyester (continuous) hollow filaments, i.e., filaments having one or more longitudinal voids, preferably such as have an ability to maintain their filament void content during drawing, and more especially to a capability to provide from the same feed stock such polyester continuous hollow filaments of various differing deniers and shrinkages, as desired, and of other useful properties, and improved processes for preparing such hollow filaments and products therefrom, including new polyester flat hollow filament yarns and bulky hollow filament yarns, as well as hollow filaments in the form of tows, resulting from such processes, and downstream products from such hollow filaments, yarns, and tows, including cut staple, and spun yarns thereof, and fabrics made from the filaments and yarns.

BACKGROUND OF THE PARENT APPLICATION (U.S. Pat. No. 5,066,447)

Textile designers are very creative. This is necessary because of seasonal factors and because the public taste continually changes, so the industry continually demands new products. Many designers in this industry would like the ability to custom-make their own yarns, so their products would be more unique, and so as to provide more flexibility in designing textiles.

For textile purposes, a "textile" yarn must have certain properties, such as sufficiently high modulus and yield point, and sufficiently low shrinkage, which distinguish these yarns from conventional feed yarns that require further processing before they have the minimum properties for processing into textiles and subsequent use. Generally, hereinafter, we refer to untextured filament yarns as "flat" yarns and undrawn "flat" filament yarns as "feed" or as "draw-feed" filament yarns. Filament yarns which can be used as a "textile" yarn without need for further drawing and/or heat treatment are referred to herein as "direct-use" filament yarns. It will be recognized that, where appropriate, the technology may apply also to polyester filaments in other forms, such as tows, which may then be converted into staple fiber, and used as such in accordance with the balance of properties that is desirable and may be achieved as taught hereinafter.

It is important to recognize that what is important for any particular end-use is the combination of all the properties of the specific yarn (or filament), sometimes in the yarn itself during processing, but also in the eventual fabric or garment of which it is a component. It is easy, for instance, to reduce shrinkage by a processing treatment, but this modification is generally accompanied by other changes, so it is the combination or balance of properties of any filament (or staple fiber) that is important. It is also understood that the filaments may be supplied and/or processed according to the invention in the form of a yarn or as a bundle of filaments that does not necessarily have the coherency of a true "yarn", but for convenience herein a plurality of filaments may often be referred to as a "yarn" or "bundle", without intending specific limitation. Many yarns have had several desirable properties and have been available in large quantities at reasonable cost; but, hitherto, there has been an important limiting factor in the usefulness of most polyester flat yarns to textile designers, because only a limited range of yarns has been available from fiber producers, and the ability of any designer to custom-make his own particular polyester flat yarns has been severely limited in practice. The fiber producer has generally supplied only a rather limited range of polyester yarns because it would be more costly to make a more varied range, e.g. of deniers per filament (dpf), and to stock an inventory of such different yarns.

Conventional flat polyester filament yarns have typically been prepared, for example, by melt-spinning at low or moderate speeds (to make undrawn yarn that is sometimes referred to as LOY and MOY) and then single-end drawing and heating to reduce shrinkage and to increase modulus and yield point. Conventional polyester filaments have combinations of properties that, for certain end-uses, could desirably be improved, as will be indicated hereinafter. Recently, there has been interest in using flat undrawn filament yarns (e.g., LOY, MOY, and most especially POY), which have generally been cheaper than drawn yarns, and incorporating a drawing step in the beaming operation, as disclosed, e.g., by Seaborn, U.S. Pat. No. 4,407,767. This process is referred to herein as "warp-drawing", but is sometimes called draw-beaming or draw-warping.

As disclosed, e.g., in the parent application (U.S. Pat. No. 5,055,447 referred to hereinabove, the disclosure of which is hereby incorporated herein by reference), it was known that conventional polyester undrawn LOY, MOY, and POY (defined hereinafter) draw by a necking operation; i.e., such conventional undrawn polyester filaments have a natural draw-ratio (NDR) and that drawing such polyester filaments at draw ratios less than this natural draw-ratio (herein referred to as partial-drawing, i.e., drawing to a residual elongation of more than about 30% in the drawn yarns) produces irregular "thick-thin" filaments which are considered inferior for most practical commercial purposes (unless a specialty yarn is required, to give a novelty effect, or special effect). For filament yarns, the need for uniformity is particularly important, more so than for staple fiber. Fabrics from flat yarns show even minor differences in uniformity from partial drawing of conventional undrawn polyester yarns as defects, especially when dyeing these fabrics. Thus, uniformity in flat filament yarns is extremely important.

Undrawn polyester filaments were unique in this respect because nylon filaments and polypropylene filaments did not have this defect. Thus, it has been possible to take several samples of a nylon undrawn yarn, all of which have the same denier per filament, and draw them, using different draw ratios, to obtain correspondingly different deniers in the drawn yarns, as desired, without some being irregular thick-thin filament yarns, like partially drawn polyester filament yarns. POY stands for partially oriented yarn POY, meaning spin-oriented yarn spun at speeds of, e.g., 2.5–3.5 km/min for use as draw feed yarns for draw-texturing as suggested in Petrilie, U.S. Pat. No. 3,771,307 and Piazza & Reese, U.S. Pat. No. 3,772,872. These draw-texturing feed yarns (DTFY) had not been used, e.g., as textile yarns, because of their high shrinkage and low yield point, which is often measurable as a low $T_7$ (tenacity at 7% elongation) or a low modulus (M). In other words, POY used as DTFY are not textile yarns (sometimes referred to as "hard yarns") that can be used as such in textile processes, but are draw feed yarns (DFY) that are drawn and heated to increase their yield point and reduce their shrinkage so as to make textile yarns. MOY means medium oriented yarns, and are prepared by spinning at somewhat lower speeds than POY, e.g., 1.5–2.5 km/min, and are even less "hard", i.e., they are even less suitable for use as textile yarns without drawing. LOY means low oriented yarns, and are prepared at much lower spinning speeds of the order of 1.5 km/min or much less.

When conventional polyester undrawn POY of high shrinkage are prepared at higher spinning speeds, there is still generally a natural draw-ratio (NDR) at which these yarns prefer to be drawn, i.e., below which the resulting yarns are irregular; although the resulting irregularity becomes less noticeable, e.g., to the naked eye or by photography, as the spinning speed of the precursor feed yarns is increased, the along-end denier variations of the partial drawn yarns are nevertheless greater than are commercially desirable, especially as it is generally desired to dye the resulting fabrics or yarns. Denier variations often mean the filaments have not been uniformly oriented along-end, and variations in orientation affect dye-uniformity. Dyeing uniformity is very sensitive to variations resulting from partial drawing, as reported, for instance, by Bosley, et al. U.S. Pat. No. 4,026,098; Lipscomb, et al. U.S. Pat. No. 4,147,749; Nakagawa, et al. U.S. Pat. No. 4,084,622; Allen, et al. U.S. Pat. No. 3,363,295. It has also been reported that such prior art drawing results in along-end spontaneous crimp on shrinkage (Schippers U.S. Pat. No. 4,019,311; col. 10/lines 44–59 and col. 11/lines 24–31). Both of these are undesirable defects for end-uses requiring uniform along-end dyeability. This has severely limited the utility of conventional spin-oriented polyester POY filament yarns, for example, as a practical draw-warping feed yarn.

Thus, previously, even with POY, such as has been used as feed yarn for draw-texturing, it had not been practical to draw-warp the same such POY to two different dpfs that vary from each other by as much as 10% and obtain two satisfactory uniform drawn yarns. Thus, it will be understood that a serious commercial practical defect of prior suggestions for draw-warping most prior undrawn polyester (POY, MOY or LOY) had been the lack of flexibility in that it had not been possible to obtain satisfactory uniform products using draw ratios below the natural draw-ratio for the polyester feed yarn.

So far as is known, it had not previously been suggested, except in the parent application, that a draw process (such as a draw-warping process) be applied to a polyester textile yarn, i.e., one that was itself already a direct-use yarn, such as having shrinkage and tensile properties that made it suitable for direct use in textile processes such as weaving and knitting without first drawing. Indeed, to many skilled practitioners, it might have seemed a contradiction in terms to subject such a yarn to draw-warping, for example, because such a yarn was already a textile yarn, not a feed yarn that needed a drawing operation to impart properties useful in textile processes such as weaving or knitting.

According to the parent application, processes were provided for improving the properties of feed yarns of undrawn polyester filaments (especially undrawn polyester filament feed yarns having the shrinkage behavior of the spin-oriented polyester filaments disclosed by Knox in U.S. Pat. No. 4,156,071, and by Frankfort & Knox in U.S. Pat. Nos. 4,134,882 and 4,195,051). Such processes involved drawing with or without heat during the drawing and with or without post heat-treatment, and are most conveniently adapted for operation using a draw-warping machine, some such being sometimes referred to as draw-beaming or warp-drawing operations; but such benefits may be extended to other drawing operations, such as split and coupled single-end drawing (or of small number of ends, typically corresponding to the number of spin packages per winder or spin position of a small unit of winders) and to various draw (and no-draw) texturing processes for providing bulky filament yarns.

BACKGROUND OF THE PRESENT INVENTION

Conventional polyester hollow filaments typically do not fully retain the same level of void content (VC) as their precursor undrawn filaments when such undrawn precursor filaments are drawn. This has been a disadvantage of these drawn hollow filaments and yarns which could have been more suitable for many uses if larger void contents had been practicable, since the presence of significant voids in such filaments could have provided additional advantages over solid filaments. Continuous hollow filament yarns could have provided advantages such as we now recognize, including increased cover (opacity), lighter weight fabrics with comparable tensiles, increased insulation (as measured by a higher CLO-value), a dry/crisp hand which enhances the "body" and drape characteristics of fabrics made using fine filament yarns. Complex drawing processes, such as the hot water super-draw process of Most in U.S. Pat. No. 4,444,710 have been utilized to develop and retain the void content (VC) in the drawing step; and have been used to supply commercial staple fibers of textile filament deniers, despite the economic and other disadvantages of using such an additional processing step, which has had to be relatively slow in practice.

It has long been desirable to provide undrawn hollow filaments for which there is essentially no loss in void content (VC) on drawing. It is desirable that any new polyester filaments should have a capability to be partially or fully drawable with or without heat and with or without post heat-treatment to uniform filaments, as disclosed by Knox and Noe in parent U.S. Pat. No. 5,066,447. It has also been desirable to supply hollow filaments in the form of a continuous multi-filament yarn versus being limited to staple fiber yarns, as continuous hollow filament yarns would provide certain advantages over conventional hollow staple yarns (e.g., slightly thicker fabrics at equal weight (i.e., greater bulk, improved insulation value (warmer) yet more permeable (greater comfort), significantly improved pilling resistance, and greater wicking (moisture transport); i.e., more like fabrics made from natural fibers). Continuous filament yarns are more easily processed in weaving and knitting and can be bulked by false-twist and air-jet texturing to offer a variety of visual and tactile fabric aesthetics that cannot be achieved with staple fiber yarns.

As discussed in detail, hereinbefore, it is always important to maintain uniformity, both along-end and between the various filaments. Lack of uniformity would often show up in the eventual dyed fabrics as dyeing defects, so is generally undesirable. Preferred hollow filaments are comprised of longitudinal voids which desirably meet additional uniformity criteria, such as being further characterized by filaments of symmetrical cross-sectional shapes and symmetrically positioned "concentric" longitudinal voids so as to limit the tendency of these hollow filaments to form along-end helical crimp on shrinkage.

SUMMARY OF THE INVENTION

According to process aspects of the invention, the following parameters are selected to provide hollow polyester filaments of significant void content, and preferably having the desirable properties already indicated.

The polyester polymer used for preparing the filaments of the invention is selected to have a relative viscosity (LRV) in the range about 13 to about 23, zero-shear melting point ($T_M^o$) in the range about 240° C. to about 265° C., and a glass-transition temperature ($T_g$) in the range about 40° C. to about 80° C.

A spin-orientation process is used, according to the invention, to prepare undrawn polyester hollow filaments, generally of denier about 1 to about 5, with longitudinal voids and a total filament void content (VC) by volume of at least about 10%, and preferably filaments of symmetric cross-sections; such as illustrated by (but not limited to), for example, filaments of round peripheral cross-section with a single concentric longitudinal void forming a tubular hollow cross-section (see FIG. 1B) and similar filaments with a hexalobal periphery; filament cross-sections having three or four longitudinal voids symmetrically-placed around a central solid core (see FIGS. 1–3 of Champaneria et al U.S. Pat. No. 3,745,061); filaments of elliptical cross-section with two longitudinal voids symmetrically-located on either side of a solid portion (see FIG. 1 of Stapp, German Patent No. DE 3,011,118); filaments of round peripheral cross-section and with six or more voids symmetrically-located around a central void (as illustrated in Broaddus, U.S. Pat. No. 5,104,725). These cross-sections are obtained by use of spinneret orifices of appropriate shape. Post coalescence is a preferred known technique for obtaining hollow filaments. The above (generally preferred) filament cross-section symmetry provides a capability to prepare uniform drawn hollow filaments which may be further characterized by exhibiting little or no tendency to develop along-end helical crimp on shrinkage. If desired, however, asymmetric filament cross-sections and/or nonconcentrically-placed longitudinal voids may be used where along-end filament crimp is desirable for certain tactile and visual aesthetics not possible with flat or textured filaments. It is also desirable, as described hereinafter, to provide and use mixed-filament yarns (wherein the filaments differ, e.g., by denier and/or void content) to provide fabrics of differing tactile aesthetics that cannot be achieved as readily by using conventional filament yarns, wherein all the filaments are essentially the same. Further variations, such as filaments of differing shrinkage, provide another variation for achieving differences in desired fabric aesthetics and functionality, e.g., as light weight fabric with lower rigidity but of higher number of yarns (sometimes referred to as "ends") per unit width than practical without higher levels of shrinkage, and of greater bulk through mixed-shrinkage than through level of void content alone.

The hollow filaments are formed by post-coalescence of polymer melt streams, preferably of temperature ($T_P$) about 25° C. to about 55° C. greater than the zero-shear polymer melting point ($T_M^o$); wherein said melt streams are formed by extruding through two or more segmented capillary orifices (see, e.g., FIGS. 4–6) arranged so as to provide an extrusion void area (EVA) about 0.2 $mm^2$ to about 2 $mm^2$ (preferably about 0.2 $mm^2$ to about 1.5 $mm^2$, and especially about 0.2 $mm^2$ to about 1 $mm^2$) such that the EVA/EA ratio of EVA to the total extrusion area (EA) is about 0.6 to about 0.9 (preferably about 0.7 to about 0.9) and the ratio of the extrusion void area EVA to the spun filament denier $(dpf)_s$, $EVA/(dpf)_s$], is about 0.2 to about 0.6 (preferably about 0.2 to about 0.4–5); and the freshly-extruded melt streams are uniformly quenched to form hollow filaments (preferably using radially-directed air of velocity ($V_a$) about 10 to about 30 meters per minute, mpm) with an initial delay preferably of length ($L_D$) of about 2 to about 10 cm, wherein the delay length is desirably decreased as the spun filament denier is decreased to maintain acceptable along-end denier variation; converged after attenuation is essentially complete into a multifilament bundle (preferably by a metered finish tip applicator guide); generally interlaced when making continuous filamentary yarns, but generally little or no interlace is used for making tow for staple; withdrawn at (spin) speeds ($V_S$) about 2000 to about 5000 m/min and generally wound into packages (for yarns, not staple). The preferred spin-orientation process is further characterized by making a selection of polymer LRV, zero-shear polymer melting point $T_M^o$, polymer spin temperature ($T_P$), spin (i.e., withdrawal) speed ($V_S$, m/min), extrusion void area (EVA, $mm^2$), and spun $(dpf)_s$ to provide an "apparent total work of extension $(W_{ext})_a$" (defined hereinafter) of at least about 1, so as to develop a void content during spinline attenuation of at least about 10%, and especially such a $W(ext)_a$ of at least about 10.

According to another aspect of the invention, there are provided novel spin-oriented as-spun undrawn i.e., hollow filament yarns of filament denier up to about 5 with a total filament void content (VC) by volume of at least about 10%, (preferably at least about 15%, and especially at least about 20%) and having a dry heat shrinkage tension peak temperature $T(ST_{max})$ of about 5° C. to about 30° C. greater than the polymer glass-transition temperature Tg; and the undrawn filaments are further characterized by an elongation-to-break ($E_B$) about 40% to about 160%, a tenacity-at-7% elongation ($T_7$) of about 0.5 g/d to about 1.75 g/d, and a $(1-S/S_m)$-ratio greater than about 0.4; preferred yarns are further characterized by an elongation-to-break ($E_B$) about 40% to about 120%, a tenacity-at-7% elongation ($T_7$) of about 0.5 g/d to about 1.75 g/d, and a (1–S/Sm)-ratio at least about 0.6; and especially preferred yarns are further characterized by an elongation-to-break ($E_B$) about 40% to about 90%, a tenacity-at-7% elongation ($T_7$) of about 1 to about 1.75 g/d, and a (1–S/Sm)-ratio greater than about 0.85, where $(1-S/S_m)$ is defined hereinafter.

The deniers of the hollow filaments are preferably in the ranges about 1 to about 4, especially about 1 to about 3, and more especially about 1 to 2. To prepare hollow textile filaments of finer denier, e.g., a dpf less than 1, it is generally desirable to use the techniques disclosed in copending application Ser. No. 07/925,042, referred to herein above, the disclosure of which is hereby incorporated herein by reference.

According to the invention, there are also provided various processing aspects of the resulting as-spun yarns, especially involving drawing, and the resulting yarns. Such processes may be, for example, generally single-end or multi-end, split or coupled, hot or cold draw processes, with or without post heat setting, for preparing uniform drawn hollow flat filament yarns and air-jet (draw)-textured hollow filament yarns of filament denier about 1 to about 4 (preferably about 1 to about 3, and especially about 1 to about 2) and of void content (VC) of at least about 10% (preferably at least about 15%, and especially at least about 20%). In draw false-twist texturing the void is typically collapsed, making the filaments "cotton-like" in shape. Drawn filaments and yarns are generally characterized by a residual elongation-to-break ($E_B$) about 15% to 40%, boil-off shrinkage (S) less than about 10%, tenacity-at-7% elongation ($T_7$) at least about 1 g/d, and preferably a post-yield modulus ($M_{py}$) about 5 to about 25 g/d.

Preferred polyester hollow undrawn and drawn "flat" filament yarns of the invention are further characterized by an along-end uniformity as measured by an along-end denier spread (DS) of less than about 3% (especially less than about 2%) and a coefficient of variation (%CV) of void content (VC) less than about 15% (especially less than about 10%).

There is is also provided a process for preparing cotton-like multifilament yarns by selecting $T_p$ to be within the range ($T_M^0$+25) to ($T_M^0$+35) and using an extrusion die characterized by total entrance angle (S+T) less than 40 degrees (preferably less than about 30 degrees) with a [(S/T)(L/W)]-value (referred to hereinafter) less than 1.25 and using delay quench length of less than 4 cm; and selecting capillary flow rate w and withdrawal speed $V_s$ such that the product of ($9000w/V_s$) and of [$1.3/(RDR)_s$] is between about 1 and 2, where $(RDR)_s$ is the residual draw-ratio of the spun undrawn filaments.

The new spin-oriented undrawn hollow filaments have the important new and advantageous capability that they can be drawn to finer filament deniers without significant loss in void content (VC); that is, their $(VC)_D/(VC)_{UD}$-ratio (i.e., ratio of void content of drawn filament to that of undrawn filament) is greater than about 0.9, preferably of about 1, and especially greater than about 1 (i.e., there is an increase in void content on drawing). Especially preferred polyester undrawn hollow filaments may also be partially (and fully) drawn to uniform filaments by hot drawing or by cold drawing, with or without post heat treatment, making such especially preferred polyester hollow filaments of the invention capable of being co-drawn with solid polyester undrawn filaments of the parent application, and/or co-drawn with nylon undrawn filaments to provide uniform mixed-filament yarns, wherein the nylon filaments may be combined with the polyester hollow filaments of the invention during melt spinning (e.g., co-spinning from same or different spin packs) or combined by co-mingling in a separate step prior to drawing.

BRIEF DESCRIPTION OF THE DRAWINGS

FIG. 1A shows filaments that are not hollow because post-coalescence was incomplete (such filaments are herein called "opens" and may be useful, as discussed herein); FIG. 1B shows round filaments according to the invention with a concentric longitudinal void (hole); and FIG. 1C shows textured hollow filaments according to the invention to show how the voids may be almost completely collapsed on draw false-twist texturing.

FIGS. 4A, 5A and 6A are all vertical cross-sections through the spinneret, whereas FIGS. 4B, 5B and 6B are, respectively, corresponding views of the spinneret face where the molten filament streams emerge, for the capillary arrangements shown in FIGS. 4A, 5A and 6A. The exit orifices of the spinneret capillaries are arranged as arc-shaped slots (as shown in FIGS. 4B, 5B and 6B) of slot width "E" separated by gaps of width "F" to provide an outer diameter (OD) of "H" and an inner diameter (ID) of (H-2E) and a ratio of (orifice) extrusion void area (EVA) to the total extrusion area (EA) of $[(H-2E)/H]^2$; where the (orifice) EVA is defined by $(3.14/4)[H-2E]^2$; the arc-shaped slots of FIG. 5B have enlarged ends (called toes) enlarged to a width (G) shown with radius (R). The orifice capillaries are shown with a height or depth (A) in FIGS. 4A, 5A and 6A. Polymer may be fed into the orifice capillaries by tapered counterbores, as shown in FIGS. 4B and 5B, where the total counterbore entrance angle (S+T) is comprised of S, the inbound entrance angle, and T, the outbound entrance angle, with regard to centerline ($C_L$). In FIG. 4A S>T. Further details of such preferred spinnerets are given in U.S. Pat. No. 5,330,348 (DP-6005) the disclosure of which is hereby incorporated herein by reference. In FIG. 5A S=T, which is more conventional. Polymer may, however, be fed by use of straight wall reservoirs (FIG. 6A) having a short angled section (B) at the bottom of the reservoir from which polymer flows from the reservoir into the orifice capillary of height or depth (A). An orifice capillary such as shown in FIG. 6A should desirably have a capillary depth (herein also referred to as a height or as a length, L) typically at least about 2× (preferably 2 to 6×) that of orifice capillaries as shown in FIGS. 4A and 5A (i.e., at least about 8 mils (0.2 mm) and preferably at least about 10 mils (0.254 mm) so as to provide a depth (L) to slot width (W) ratio (in FIGS. 6A and 6B as A and E, respectively) of about 2 to about 12; whereas conventional A to E ratios of depth/width, (L/W), are generally less than about 2. This greater depth/width (L/W)-ratio provides for improved uniform metering of the polymer and increased die-swell for higher void content. To provide sufficient pressure drop, as required for flow uniformity, all of the capillaries used herein incorporate a metering capillary (positioned further above and not shown in FIGS. 4–6). As the orifice capillary depth (L) is increased, however, the need for an "extra" metering capillary becomes less important as well as the criticality of the values and symmetry of the entrance angles of the spinnerets using tapered counterbores (FIG. 4A and 5A).

It will be understood that a family of hollow filaments like FIG. 11 A could be made with differing void contents, but the same denier. Fabrics made from such Filaments 11A would weigh the same as those from IID, but would be bulkier and have more "rigidity", i.e. the filaments have more resistance to bending. Filaments depicted by 11B are hollow and designed to have the same "rigidity" (resistance) to bending as those from 11D; this "rigidity" defines, in part, the "drape" or "body" of a fabric, so fabrics made from Filaments 11B and 11D would have the same drape. It will be noted that there is less polymer in the wall of FIG. 11B than for FIG. 11A, and, therefore, for FIG. 11D. So fabrics from these filaments from FIG. 11B would be of lower weight and greater bulk than those for FIG. 11D. Again, a family of hollow filaments like FIG. 11B could be made with differing void contents, but the same "rigidity". Filaments depicted by FIG. 11C have the same outer diameter ($d_o$) as FIG. 11D. Again, a family of such hollow filaments like FIG. 11C could be made with differing void contents, but the same outer diameter. Fabrics made from filaments 11C and 11D would have the same filament and fabric volumes, but such fabrics made from filaments 11C would be lighter and of less "rigidity". Additional discussion of filaments of the types represented by FIGS. 11A, B, C, and D is in Example XXIV.

Figure 11A:
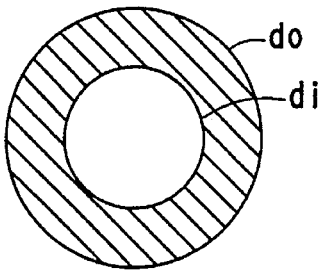
FIGS. 11A through 11D depict cross-sections of round filaments with an Outer Diameter (OD) of D in FIG. 11D for solid filaments where there is no void, and $d_o$ in FIGS. 11A, 11B, and 11C, for three representative types of comparable hollow filaments according to the invention, where there are voids. The Inner Diameter (ID) is noted as $d_i$ in the latter figures. Filaments depicted by 11A are hollow but have the same denier (mass per unit length) as the solid filaments of FIG. 11D; that is, their cross-sections contain the same amount of polymer (i.e., total cross-sectional area of 11D equals the annular hatched area of the "tube wall" of 11A).
Figure 11B:
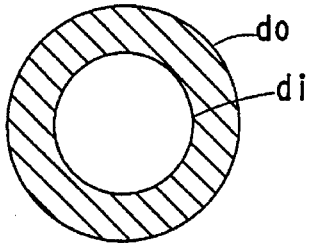
Figure 11C:
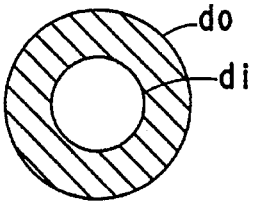
Figure 11D:
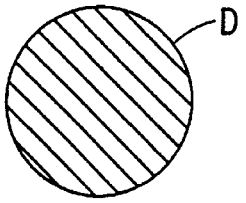
Figure 12:
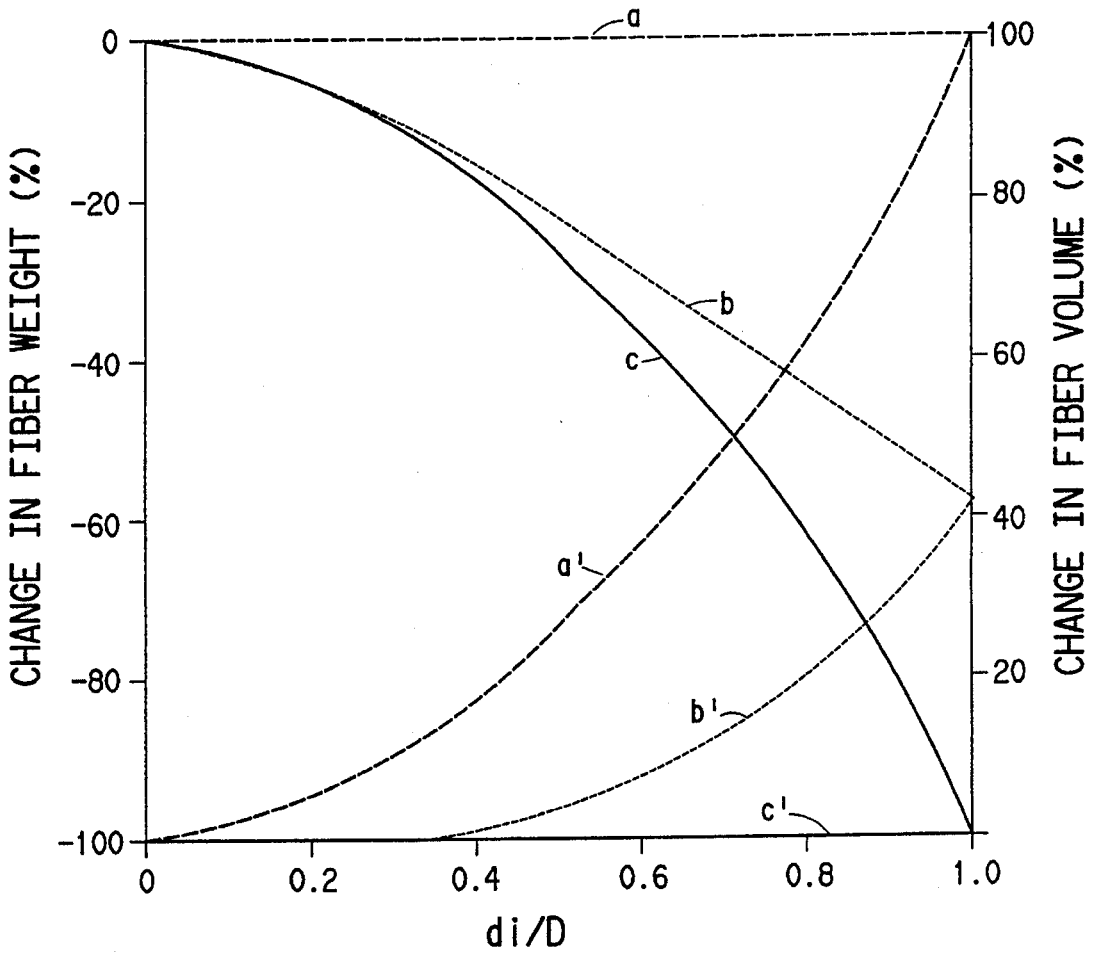

FIG. 12 plots change (decrease) in fiber (fabric) weight (on the left vertical axis) versus increasing void content (VC), i.e., with increasing ($d_i$/D)-ratio, where lines a, b and c, respectively, represent the changes in weight of filaments (and fabric therefrom) of the families represented by FIGS. 11A, 11B, and 11C. For instance, for the family of filaments of FIG. 11A, the denier will remain constant even as the $d_i$ and void content increase, so line a is horizontal indicating no change in filament weight as void content increases. FIG. 12 also plots fiber (fabric) volume (on the right vertical axis) versus void content ($d_i$/D) where lines a', b', and c' correspond to the families of filaments of FIGS. 11A, 11B, and 11C, respectively. In this case, line c' is horizontal, as the outer diameter of FIG. 11C remains constant.

Figure 13:
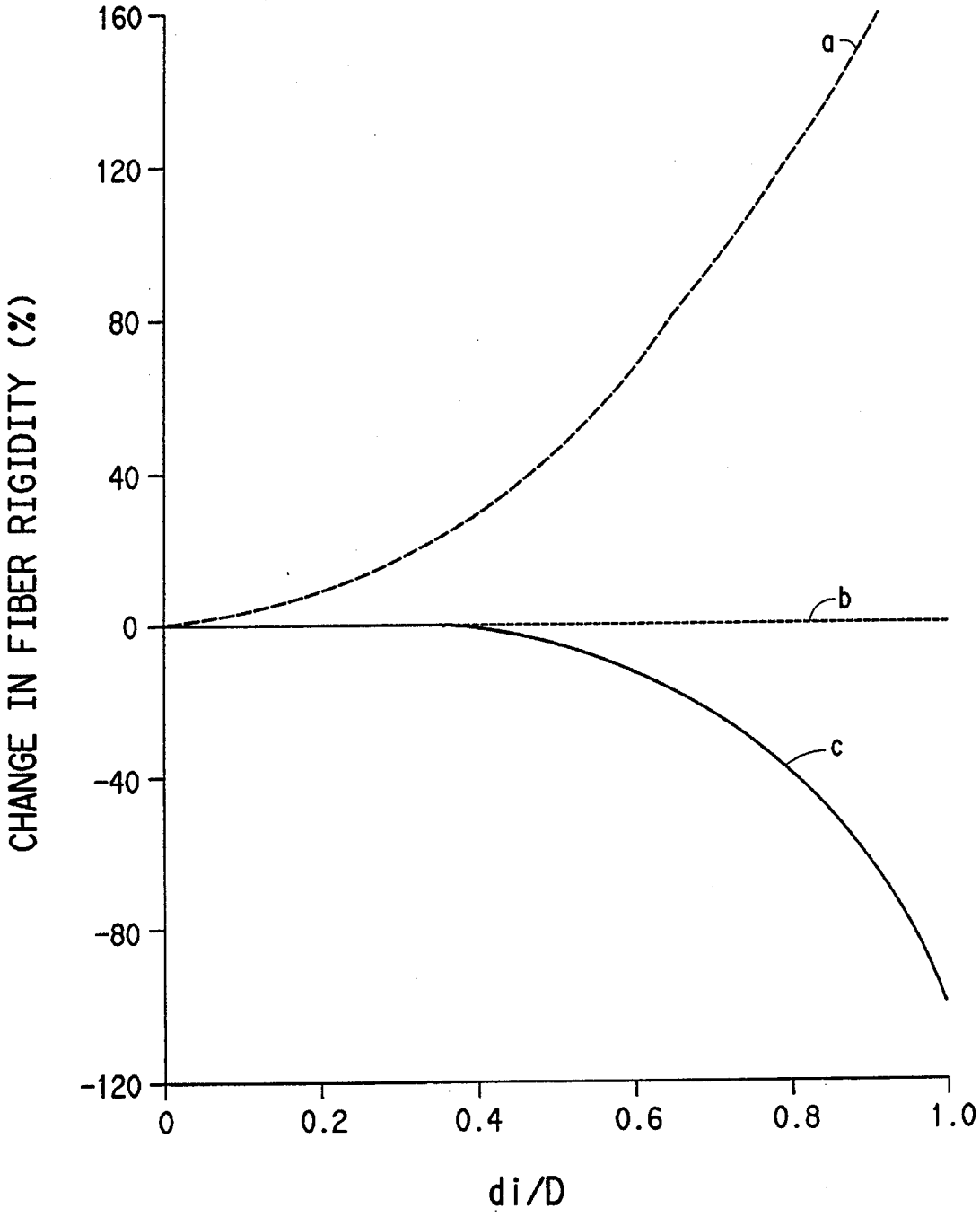

FIG. 13 plots the change in fiber (fabric) "rigidity" (bending modulus) versus void content ($d_i$/D), where lines a, b, and c correspond to filaments of FIGS. 11A, 11B, and 11C, respectively. In this case, line b is horizontal since the "rigidity" of the filaments of FIG. 11B is kept constant even as the void content increases.

DETAILED DESCRIPTION OF THE INVENTION

The polyester polymer used for preparing spin-oriented filaments of the invention is selected to have a relative viscosity (LRV) in the range about 13 to about 23, a zero-shear melting point ($TM_M^o$) in the range about 240° C. to about 265° C.; and a glass-transition temperature ($T_g$) in the range about 40° C. to about 80° C. (wherein $T_M^o$ and $T_g$ are measured from the second DSC heating cycle under nitrogen gas at a heating rate of 20° C. per minute). The said polyester polymer is a linear condensation polymer composed of alternating A and B structural units, where the A's are hydrocarbylenedioxy units of the form —O—R'—O— and the B's are hydrocarbylenedicarbonyl units of the form —C(O)—R"—C(O)—, wherein R' is primarily —$C_2H_4$—, as in the ethylenedioxy (glycol) unit —O—$C_2H_4$—O—, and R" is primarily —$C_6H_4$—, as in the 1,4-benzenedicarbonyl unit —C(O)—$C_6H_4$—C(O)—, such to provide, for example, at least about 85 percent of the recurring structural units as ethylene terephthalate, —O—$C_2H_4$—O—C(O)—$C_6H_4$—C(O)—. Suitable poly(ethylene terephthalate), herein denoted as PET or 2GT, based polymer may be formed by a DMT-process, e.g., as described by H. Ludewig in his book "Polyester Fibers, Chemistry and Technology", John Wiley and Sons Limited (1971), or by a TPA-process, e.g., as described in Edging U.S. Pat. No. 4,110,316. Included are also copolyesters in which, for example, up to about 15 percent of the hydrocarbylenedioxy and/or hydrocarbylenedicarbonyl units are replaced with different hydrocarbylenedioxy and hydrocarbylenedicarbonyl units to provide enhanced low temperature disperse dyeability, comfort, and aesthetic properties. Suitable replacement units are disclosed, e.g., in Most U.S. Pat. No. 4,444,710 (Example VI), Pacofsky U.S. Pat. No. 3,748,844 (Col. 4), and Hancock, et al. U.S. Pat. No. 4,639,347 (Col. 3).

Polyester polymers, used herein, may, if desired, be modified by incorporating ionic dye sites, such as ethylene-5-M-sulfo-isophthalate residues, where M is an alkali metal cation, for example in the range of about 1 to about 3 mole percent, and representative chain branching agents used herein to affect shrinkage and tensiles, especially of polyesters modified with ionic dye sites and/or copolyesters, are described in part by Knox in U.S. Pat. No. 4,156,071, MacLean in U.S. Pat. No. 4,092,229, and Reese in U.S. Pat. Nos. 4,883,032; 4,996,740; and 5,034,174. To obtain undrawn feed yarns of low shrinkage from modified polyesters, it is generally advantageous to increase polymer viscosity by about +0.5 to about +1.0 LRV units and/or add minor amounts of chain branching agents (e.g., about 0.1 mole percent). To adjust the dyeability or other properties of the spin-oriented filaments and the drawn filaments therefrom, some diethylene glycol (DEG) may be added to the polyester polymer as disclosed by Bosley and Duncan U.S. Pat. No. 4,025,592 and in combination with chain-branching agents as described in Goodley and Taylor U.S. Pat. No. 4,945,151.

The undrawn hollow filaments of the invention are formed by post-coalescence of polyester polymer melt streams, such as taught by British Patent Nos. 838,141 and 1,106,263, by extruding polyester polymer melt at a temperature ($T_P$) that is about 25° C. to about 55° C. greater than the zero-shear melting point ($T_M^o$) of the polyester polymer, first through metering capillaries of diameter (D) and Length (L), as described in Cobb U.S. Pat. No. 3,095,607 (with dimensions (D)×(L) being modified, if desired, by use of an insert as described by Hawkins U.S. Pat. No. 3,859,031) and which are similar to those used in Example 6 of Knox U.S. Pat. No. 4,156,071; and then through a plurality of segmented orifices, as illustrated, for example, in FIG. 1 of Hodge U.S. Pat. No. 3,924,988, in FIG. 3 of Most U.S. Pat. No. 4,444,710, and in FIG. 1 of Champaneria, et al U.S. Pat. No. 3,745,061, and further illustrated herein in FIGS. 4B, 5B, and 6B.

Figure 1A:
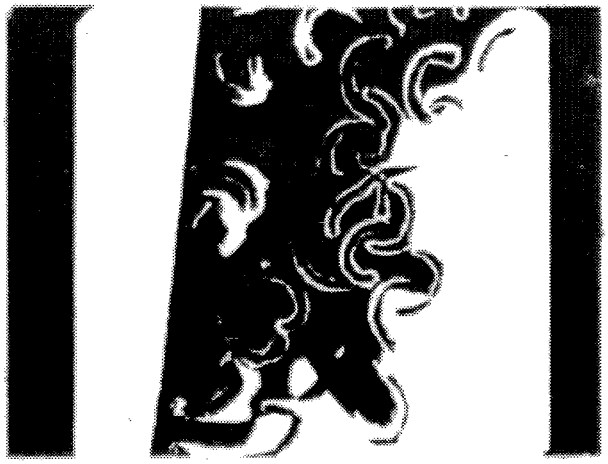
FIGS. 1A–1C are representative enlarged photographs of cross-sections of filaments.
Figure 1B:
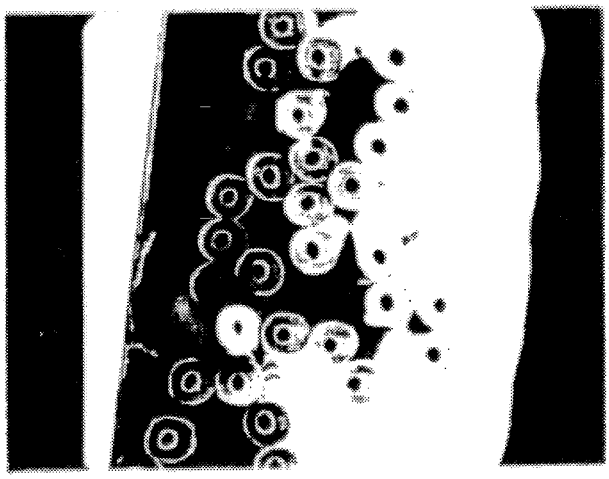
Figure 4A:
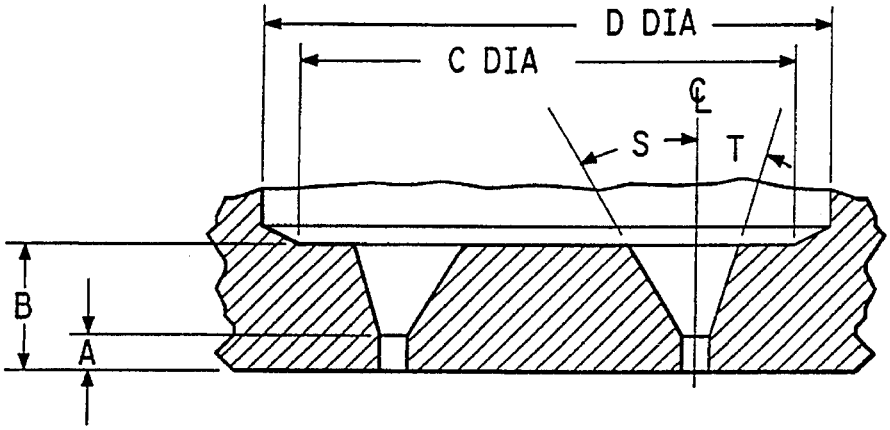
FIGS. 4A and 4B, 5A and 5B, 6A and 6B show schematically representative spinneret capillary arrangements for spinning peripherally round filaments having a single concentric longitudinal void (different capillary spinnerets would be required if more than one longitudinal void or if filaments of non-round cross-sections were desired).
Figure 5A:
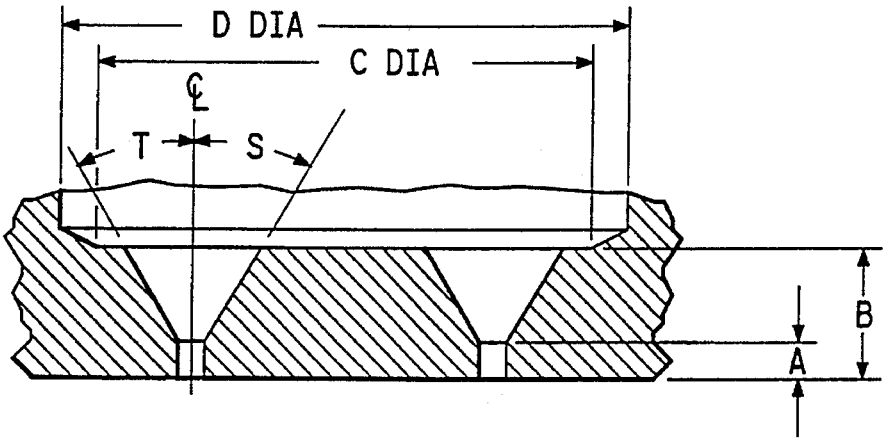
Figure 6A:
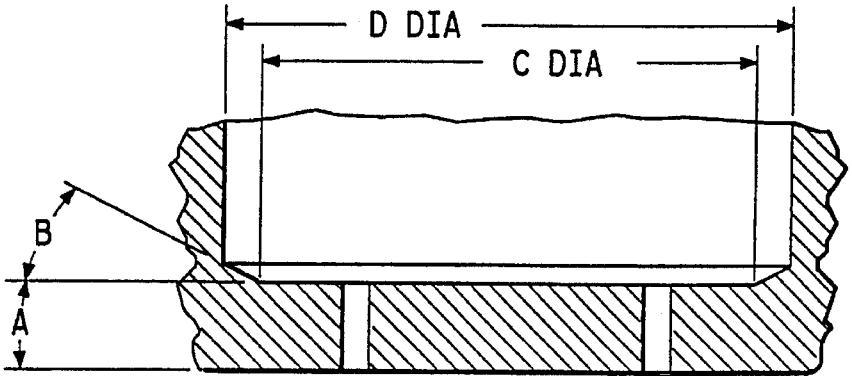

When using short orifice capillaries (as shown, e.g., in FIGS. 4A and 5A), the use and configuration of a tapered counterbore is preferred for obtaining large void content and complete coalescence. Preferred such counterbores, used herein, are generally characterized by a total entrance angle (taken herein as the sum of the inbound entrance angle S and the outbound entrance angle T) about 30 to about 60 degrees (preferably about 40 to about 55 degrees); wherein the inbound entrance angle S is at least about 15 degrees, and preferably at least 20 degrees, and the outbound entrance angle T is at least about 5 degrees, preferably, at least about 10 degrees; such that the (S/T)-ratio is in the range of about 1 to about 5.5 (preferably in the range of about 1.5 to about 3) when extruding at low mass flow rates (i.e., low dpf filaments) from orifice capillaries with slot depth/width ratios (L/W)-ratios less than about 2. It will be understood that these preferences, expressed generally, do not guarantee obtaining optimum filaments, or even complete coalescence, for example, but other considerations will also be important. For instance, the spinnerets used in Example I and for other Examples were of total entrance angle 60 degrees, and gave excellent hollow filaments as well as comparisons that are not according to the invention. It should also be noted that a counterbore with a total entrance angle (S+T) of 30 degrees and S=T gave "opens" as illustrated in FIG. 1A, and Example XXII. When using deep orifice capillaries (e.g., as shown in FIG. 6A), then the configuration of the counterbore is less critical and a simpler reservoir type may be used (FIG. 6A).

Figure 4B:
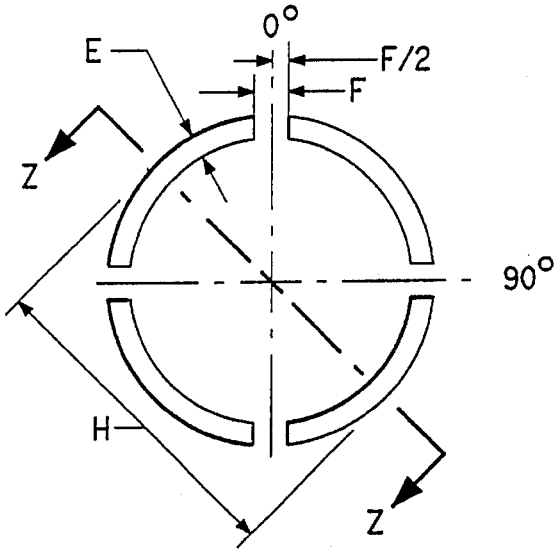
Figure 5B:
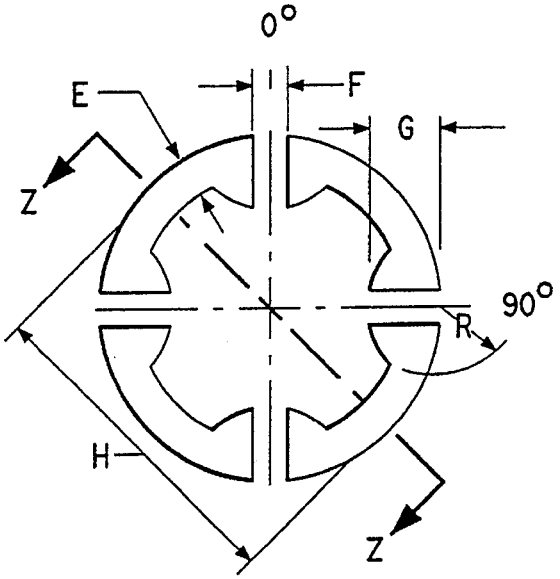
Figure 6B:
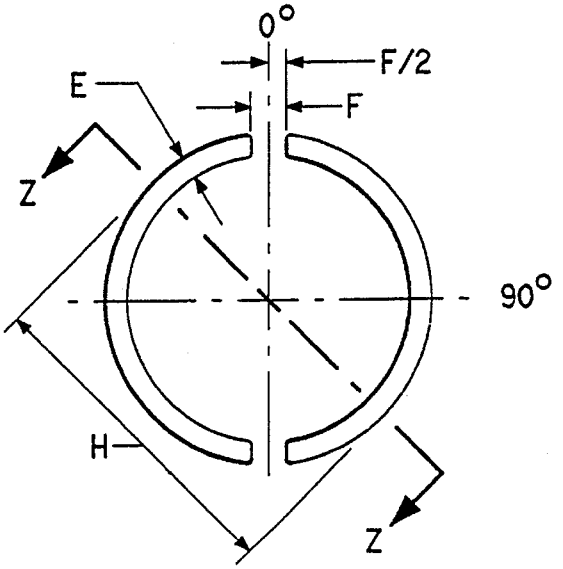

For the present invention, the arc-shaped orifice segments (as depicted in FIGS. 4B, 5B and 6B) are arranged so to provide a ratio (EVA/EA) of the extrusion void area (EVA) to the total extrusion area (EA) between about 0.6 and about 0.9 (preferably about 0.7 to about 0.9) for an extrusion void area EVA, about 0.2 $mm^2$ to about 2 $mm^2$ (preferably about 0.2 to about 15 $mm^2$ and especially about 0.2 to about 1 $mm^2$). These calculations, for simplification, ignore the areas contributed by small solid "gaps", called "tabs" between the ends of the capillary arc-orifices. Frequently, the arc-shaped orifices may have enlarged ends (herein referred to as "toes"), as illustrated in FIG. 5B, to compensate for polymer flow not provided by the tabs between the orifice segments. This is especially important under conditions wherein insufficient extrudate bulge is developed for complete and uniform post-coalescence. It is observed that for filaments of spun denier of about 2 to about 5, orifices with "toes" and having symmetric entrance angles to the slots (e.g., with inbound entrance angle S=outbound entrance angle T) as shown in FIGS. 5A and 5B are generally sufficient to provide uniform hollow filaments. However, as the spun denier $(dpf)_s$ is decreased to less than about 2 denier, such orfices tend to provide a reduction in filament void content to values less than about 10%, and a greater propensity for incomplete post-coalescence leading to "opens" as illustrated in FIG. 1A. It is found that extruding from arc-shaped orifices without "toes" as illustrated in FIG. 4B, and reducing the extrusion void area (EVA) to values in the range of about 0.2 $mm^2$ to about 1.5 $mm^2$ (especially about 0.2 $mm^2$ to about 1 $mm^2$) with a (EVA/EA)-ratio of about 0.7 to 0.9 is preferred for forming uniform fine denier hollow filaments. If there is insufficient extrudate bulge at these low polymer flow rates, then it is preferred to enhance and direct the extrudate bulge by using asymmetric orifice counterbores (see FIG. 4A), as discussed hereinabove or alternatively using deep orifice capillaries as illustrated in FIG. 6A with slot depth "L" to slot width "W" ratios (L/W), of about 2 to about 12, and especially about 4 to about 12 to achieve the desired void content and complete post-coalescence.

After formation of the arc-shaped melt streams using sufficiently carefully selected spinnerets, as described hereinabove, the freshly-extruded melt streams post-coalesce to form hollow filaments, wherein the void is desirably essentially continuous and symmetric along the length of the filament. It is preferred to protect the extruded melt during and immediately after post-coalescence from stray air currents. This may be accomplished by use of cross-flow quench fitted with a delay tube, for example, as described by Makansi in U.S. Pat. No. 4,529,368, and preferably by use of radial quench fitted with a delay tube, for example, as described by Dauchert in U.S. Pat. No. 3,067,458 wherein the delay tube is of short lengths, typically between about 2 to about 10 cm as used in Examples 1, 2 and 11 of Knox U.S. Pat. No. 4,156,071 and in the recently granted patent application Ser. No. 07/338,252. Radial quench is preferred versus cross-flow quench for it typically provides for greater void retention during attenuation and quenching as previously reported by Broaddus in U.S. Pat. No. 4,712,988. It is observed, herein in Examples V-10,11, and 12, that as the spun denier $(dpf)_s$ is decreased, along-end denier uniformity is maintained (and in some cases, improved) by shortening the length of the delay ($L_D$) in the radial quench assembly which is consistent with the teaching of the allowed U.S. Pat. No. 5,066,447. It is also observed that increasing the extrudate viscosity by use of lower polymer temperatures ($T_P$) and/or reduced delay quench, provides for increased percent void content; too high an extrudate melt viscosity for a given degree and rate of attenuation, however, can lead to incomplete post-coalescence (called "opens"—see FIG. 1A) and filament breaks.

The quenched hollow filaments are then converged into a multi-filament bundle at a distance ($L_c$) typically between about 50 and 150 cm from the point of extrusion. The convergence of the fully quenched filament bundles is preferably by metered finish tip applicators as described by Agers in U.S. Pat. No. 4,926,661. The length of the convergence zone ($L_c$), length of quench delay ($L_D$) and air flow velocity ($V_a$) are desirably selected to provide for uniform filaments characterized by along-end denier variation [herein referred to as Denier Spread, DS] of less than about 4% (preferably less than about 3%, and especially less than 2%). For example, radial quench with a 10 cm delay was acceptable for spinning 1.7 dpf at 2.286 km/min, but was unacceptable for spinning of 1.2 dpf at that speed. Decreasing delay length ($L_D$) to about 2–3 cm provided acceptable along-end uniformity at that speed. The length of the convergence zone ($L_c$) may also be varied, within reason, to help obtain an acceptable denier spread; but at sufficiently high spin speeds it is known that shortening the convergence zone also moderately increases the spinning stress, thereby decreasing the spun yarn elongation, and shrinkage as disclosed in the German Patent No. 2,814,104 for spinning of solid filaments. This approach may be taken herein as a secondary way to vary slightly the spun filament tensile and shrinkage properties for a given spin speed ($V_S$) and $(dpf)_s$ and to increase the void content (VC).

The converged filament bundles are then withdrawn at spin speeds ($V_S$) between about 2 to 5 km/min (preferably between about 2.5 and 4.5 km/min). The filaments are generally interlaced, and wound into packages of continuous filament yarn, if this is what is desired. Finish type and level and extent of filament interlace is selected based on the end-use processing needs. Advantageously, if desired, hollow filaments may be prepared according to the invention from undrawn feed yarns that have been treated with caustic in the spin finish (using techniques, as taught for example, in U.S. Pat. Nos. 5,069,844 and 5,069,847) to enhance the hydrophilicity of the hollow filaments and provide improved moisture-wicking and comfort. Yarn interlace is preferably provided by use of an air-jet, as described in Bunting and Nelson U.S. Pat. No. 2,985,995, and in Gray U.S. Pat. No. 3,563,021, wherein the degree of interfilament entanglement (herein referred to as rapid pin count RPC) is as measured according to Hitt in U.S. Pat. No. 3,290,932.

We have observed that void content (VC) increases with spinning speed and as-spun filament denier $(dpf)_s$. To spin finer denier filaments without loss in void content (VC), the spinning speed ($V_S$) may be increased. In addition to spinning speed ($V_S$) and filament denier $(dpf)_s$, the filament void content (VC) is found to increase with polymer melt viscosity [herein for polyester found to be approximately proportional to product of the polymer relative viscosity (LRV) and the ratio of the zero-shear polymer melting point ($T_M^o$) and the extrusion polymer temperature ($T_P$) taken to the 6th power; e.g., proportional to $[LRV(TM_M^o/T_P)^6]$. Further, the percent void content (VC) is also observed to increase approximately linearly with the square root of the extrusion void area EVA; that is, increasing linearly with the inner diameter (ID) for orifices having a EVA/EA-ratio $[=(ID/OD)^2]$ about 0.6 to about 0.9 (preferably about 0.7 to about 0.9).

From the above discussion, the preferred process for providing undrawn filaments having void content (VC) of at least about 10% may be expressed by a phenomenological process expression:

$$VC,\%=K_pLog_{10}\{(k]LRV(T_M^o/T_P)^6][(dpf)_s(V_S)^2)][(EVA)^{1/2}])^n\}$$

where the expression in brackets { } is taken, herein, to be a representative measure of the "apparent work of extension" $(W_{ext})_a$ that the hollow filament undergoes during attenuation; where "$K_p$" is the slope of the semilog plot of VC(%) versus $(W_{ext})_a$ and the value of $K_p$ is taken herein to be a measure of the inherent "viscoelastic" nature for a given polymer that determines, in part, the extent of die-swell; and the value of the exponent "n" is dependent of the "geometry" of the orifice exit capillary (i.e., on the values of S/T and L/W); and for simplicity the value of "n" is herein given by the expression [(S/T)(L/W)]. In the case of the orifice capillary of large values of (L/W) as depicted in FIG. 6A, it is expected that the value of "n" will not be linear with (L/W); but will level off (i e , $(L/W)^m$, where m is less than 1, as equilibrium flow is established with respect to (L/W) and die-swell becomes independent of (L/W). When using a reservoir as depicted in FIG. 6A, the value of (S/T) is defined as "1". A reference state is defined, herein, for orifice capillaries having symmetric entrance angles (S=T) and slot depth (L) is equal to slot width (W) giving a value of (L/W) of 1 and thereby giving a value of n of 1. The constant "k" is a proportionality constant of value $10^{-7}$ (as defined by the units selected for $V_S$ and EVA) and $(W_{ext})_a$ has a value of 10 for the reference state; and thereby the void content at the reference state is defined by: VC (%)=$K_p$Log{101}=$K_p$; wherein the value of the value of Kp is arbitrarily selected to have a numerical value of "10" for 2GT homopolymer so that at process conditions that provide a $W(_{ext})_a$ value of 10, the filament void content (VC) is 10%. The above phenomenological approach permits the void content (VC) to be directly related to the process parameters, through the values $(W_{ext})$a, to the geometry of the extrusion orifice (through the value of "n") and to the selected polymer (through the value of $K_p$). In the expression for $(W_{ext})_a$, the spin speed ($V_S$) is expressed in meters per minute and orifice capillary EVA is expressed in $mm^2$.

The above expression suggests that void content (VC) may be increased by increasing the "apparent extensional work" (i.e., by increasing spin speed, ($V_S$), extrusion void area EVA, polymer LRV, filament denier $(dpf)_s$, and decreasing polymer temperature $T_P$) and provides a process rationale for forming fine filaments of high void content. To counter the reduction in void content with reduced filament denier $(dpf)_s$, the spin speed($V_S$), capillary extrusion void area (EVA), and polymer relative viscosity (LRV) may be increased and the polymer temperature ($T_P$) may be decreased. In practice, it is found that increasing the extrusion void area (EVA) to counter the lower void content from spinning lower $(dpf)_s$ may yield unacceptably high values of melt extension $[(EVA/(dpf)_s]$ and poor spinning continuity. It is preferred to maintain the ratio $[EVA/(dpf)_s]$ between about 0.2 to about 0.45 for good spinning performance and obtain the desired void content by increasing spin speed, for example.

The spin-orientation process of the invention provides undrawn hollow filament yarns of filament denier of about 1 to about 5 (preferably about 1 to about 4, especially about 1 to about 3, and more especially of about 1 to about 2), where filaments of different deniers and/or cross-sections may also be used to reduce filament-to-filament packing and thereby improve tactile aesthetics and comfort (such as, mixing hollow filaments of different cross-sectional shape and/or denier; and mixing hollow filaments with solid filament of different denier and/or cross-sectional shape); and of filament percent void content (VC) at least about 10%, preferably at least about 15%, and especially at least about 20%; and characterized by a maximum shrinkage tension ($ST_{max}$) of less than about 0.2 g/d occurring at a shrinkage tension peak temperature $T(ST_{max})$ of about 5° C. to about 30° C. greater than about the glass-transition temperature of the polymer; and further characterized by boil-off shrinkage (S) less than about 50% (preferably less than about 30% and especially less than about 10%) and an elongation-to-break ($E_B$) in the range of about 40% to about 160% (preferably in the range of about 40% to 120% and especially in the range of about 40% to about 90%) such to provide a ($1-S/S_m$)-value (defined hereinafter) of at least about 0.4 (preferably at least about 0.6 and especially at least about 0.85). The especially preferred undrawn filament feed yarns are further characterized by a thermal stability (S2) less than about +2%, and a tenacity-at-7% elongation ($T_7$) greater than about 1 g/d.

The undrawn hollow filaments of the invention may be drawn in coupled spin/draw processes, such as described by Chantry and Molini in U.S. Pat. No. 3,216,187, or in split spin/draw processes, including single end as well as multi-end processes, e.g., warp-draw processes as described generally by Seaborn in U.S. Pat. No. 4,407,767, and, more specifically for undrawn low shrinkage homopolymer polyester yarns, by Knox and Noe in U.S. Pat. No. 5,066,447, and for copolymer polyester undrawn feed yarns as described by Charles et al in U.S. Pat. Nos. 4,929,698 and 4,933,427. The drawing process may be part of a texturing process, such as draw air-jet texturing, draw false-twist texturing, draw stuffer-box crimping, and draw gear crimping for example. However, the textured hollow filaments of the invention, depending on the type of bulky process selected (e.g., draw false-texturing) may have a unique "corrugated" cross-sectional shape as a result of partially (and fully) collapsed voids and thereby provide an irregular filament cross-section similar to that of cotton. Textured filaments of "collapsed-hollow" cross-section and of denier about 1.5 or less are especially suitable for replacement of cotton staple yarns. Drawn flat and textured yarns of the invention are generally characterized by residual elongation-to-break ($E_B$) about 15% to about 40%, boil-off shrinkage (S), such that the ($1-S/S_m$) value is at least about 0.85, tenacity-at-7% elongation ($T_7$) at least about 1 g/d, and preferably a post-yield modulus ($M_{py}$) about 5 to about 25 g/d. Drawing (including selection of draw temperatures and post draw heat set temperatures) to provide a combination of shrinkage (S) shrinkage tensions ($ST_{max}$), such that shrinkage power, $P_s[=S\times ST_{max}$, (g/d)%] is greater than about 1.5 (g/d)%, are especially preferred to provide sufficient shrinkage power to overcome filament-to-filament restraints within high end-density fabrics, such as medical barrier fabrics.

An important characteristic of the invention is that the undrawn hollow filaments may be drawn to reduce their denier without a significant reduction in the percent void content (VC) during the drawing process; that is, the drawn filaments have essentially the same percent void content (VC) as that of the undrawn hollow feed filaments prior to drawing. Using carefully selected drawing conditions, the percent void content (VC) of the hollow undrawn filaments of the invention may even be increased during the drawing process. Any change in percent void content (VC) observed on drawing undrawn hollow filaments of the invention may be described by the ratio of the percent void content of the drawn filaments $(VC)_D$ to that of the undrawn filaments $(VC)_{UD}$. Drawn hollow filaments of this invention generally have a $(VC)_D/(VC)_{UD}$-ratio of at least about 0.9 and preferred drawn hollow filaments of the invention have a $(VC)_D/(VC)_{UD}$-ratio of at least about 1, which has not heretofore been disclosed in the prior art of drawing of undrawn hollow filaments. Especially preferred undrawn filaments may be drawn without loss in void content over a wide range of drawing conditions, including being capable of being uniformly partially drawn by cold or by hot drawing, with or without post heat treatment, to elongations $(E_B)$ greater than 30% without along-end "thick-thin" denier variations as described in U.S. Pat. No. 5,066,447 for undrawn filaments of low shrinkage; and such especially preferred undrawn filaments are also suitable for use without drawing as flat direct-use textile filaments and may be air-jet textured without drawing or post heat treatment to provide bulky textured yarns of low shrinkage.

It is believed that the unique retention of the void content (VC) of the undrawn hollow filaments of the invention on drawing to finer filament deniers, is related, in part, to the development of stress-induced orientation (SIO) of the amorphous regions during melt spinning and to the resultant stress-induced crystallization (SIC) of these oriented amorphous regions. For polyester, the onset temperature of cold crystallization $(T_{cc})$ of the amorphous regions is typically about 135° C. for amorphous unoriented filaments and is decreased to less than 100° C. with increased stress-induced orientation (SIO) of the amorphous polymer chains. This is graphically illustrated in FIG. 3B by a plot of $T_{cc}$ versus the amorphous birefringence. For the preferred undrawn spin-oriented filaments with elongations $(E_B)$ in the range of 40% to about 120%, the measured $T_{cc}$-values for polyester are in the range of about 90° C. to about 110° C. which is believed to permit the onset of further crystallization even under mild drawing conditions and is believed, in part, to be important for the retention of void content (VC) of undrawn hollow polyester filaments of the invention on drawing, even when drawn cold (i.e., when the exothermic heat of drawing is the only source of heating) .

The degree of stress-induced crystallization (SIC) is also believed, herein, to be important in the drawing behavior of the hollow filaments of the invention and is conventionally defined by the density of the polymeric material forming the "walls" of the hollow fiber; wherein, density (walls)=density (measured) divided by (1-VC/100), where $VC=(ID/OD)^2\times 100\%$ for round filaments. For non round filaments, the estimation of VC and hence density of the walls becomes more difficult. The density of the walls can, however, be estimated from the shrinkage S of the hollow filament, if one can assume that the relationship between shrinkage S and density is the same as that for corresponding spin-oriented solid filaments depicted in FIG. 3A. An indirect measure of stress-induced crystallization (SIC) used herein is the extent of boil-off shrinkage (S) for a given yarn elongation-to-break $(E_B)$. For a given fiber polymer crystallinity (i.e., "wall" density), the boil-off shrinkage (S) is expected to increase with molecular extension (i.e., with decreasing elongation-to-break, $E_B$); and therefore a relative degree of stress-induced crystallization (SIC) is defined, herein, by the expression: $(1-S/S_m)$, where $S_m$ is the expected maximum shrinkage potential for filaments of a given degree of molecular extension $(E_B)$ in the absence of crystallinity; and $S_m$ is defined herein by the expression:

$$S_m(\%)=(]((E_B)_{max}-E_B)]/[(E_B)_{max}+100])100\%,$$

wherein $(E_B)_{max}$ is the expected maximum elongation-to-break $(E_B)$ of totally amorphous "isotropic" filaments. For polyester filaments spun from polymer of typical textile intrinsic viscosities in the range of about 0.56 to about 0.68 (corresponding to LRV-values of about 16 to about 23), the nominal value of $(E_B)_{max}$ is experimentally found to be about 550% providing for a maximum residual draw-ratio of 6.5 (Reference: High-Speed Fiber Spinning, ed. A. Ziabicki and H. Kawai, Wiley-Interscience (1985),page 409) and thus, $S_m$ (%) may in turn be defined, herein, by the simplified expression:

$$S_m,\%=[(550-E_B)/650]\times 100\%$$

Figure 2:
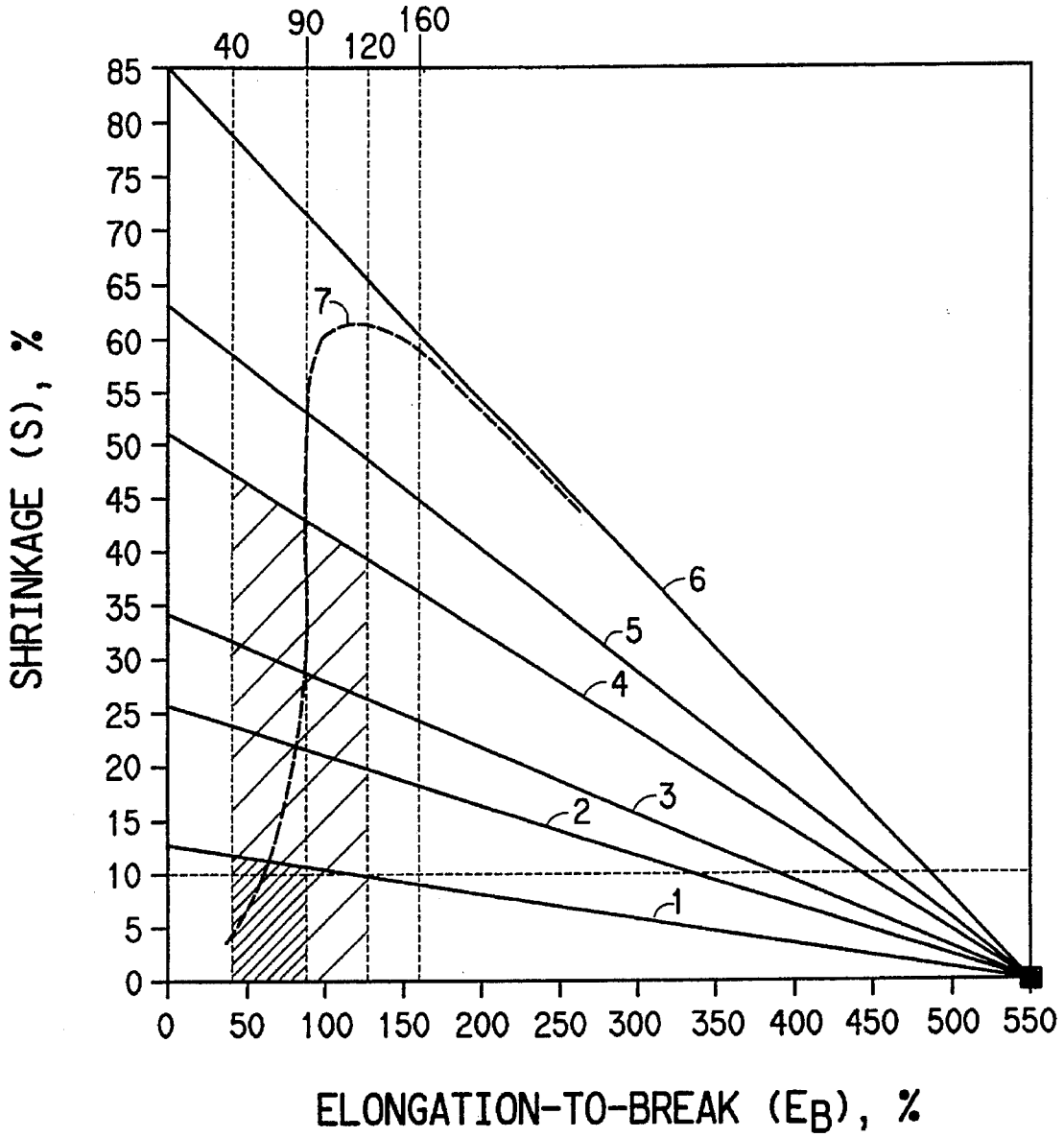
FIG. 2 is a representative plot of percent (boil-off) shrinkage (S) versus percent elongation-to-break ($E_B$) wherein (straight) Lines 1, 2, 3, 4, 5, and 6 represent ($1-S/S_m$)-values of 0.85, 0.7, 0.6, 0.4, 0.1, and 0, respectively and curved Line 7 represents a typical shrinkage versus elongation-to-break relationship for a series of yarns formed, for example, by increasing spinning speed, but keeping all other process variables unchanged. Changing other process variables (such as dpf, polymer viscosity) would produce a "family" of similar curves, essentially parallel to line 7. The vertical dashed lines denote ranges of $E_B$-values for preferred filaments of the invention, i.e., 40% to 90% for a direct-use yarn and 90% to 120% for a draw feed yarn, with 160% as a practical upper limit, based on age stability. The preferred hollow filaments of the invention, denoted by the "widely-spaced"//////-area, are especially suitable as draw feed yarns, having $E_B$-values of about 40% to 120% and ($1-S/S_m$) value of at least about 0.4 (below line 4); and the preferred hollow filaments of the invention, denoted by the "densely-spaced"/ /////-area bordered by $E_B$-values of about 40% to about 90% and ($1-S/S_m$) ratio at least about 0.85 (below line 1), are especially suitable as direct use textile filaments.
Figure 3A:
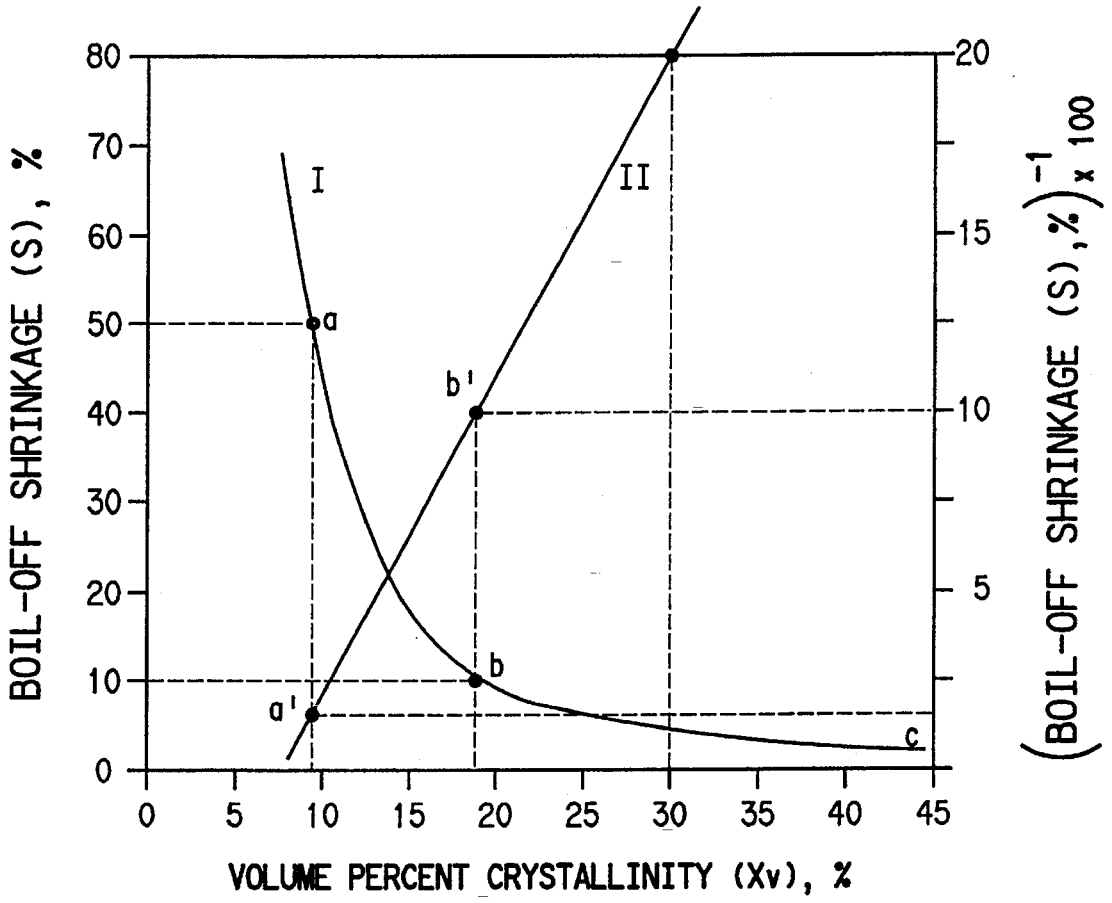
FIG. 3A shows two lines (I and II) plotting the shrinkage (S) versus volume percent crystallinity (Xv), measured by flotation density and corrected for % pigment, being a measure of the extent of stress-induced crystallization (SIC) of the amorphous regions during melt-spinning, where Line I is a representative plot of percent boil-off shrinkage (S) of spin-oriented "solid" filaments (not according to the invention) having a wide range of elongations-to-break ($E_B$) from about 160% to about 40%, spun using a wide range of process conditions (e.g., filament denier and cross-section, spin speed, polymer LRV, quenching, capillary dimensions (L×D), and polymer temperature $T_P$). It will be noted that the shrinkages (S) fall on a single curve (Line I) and that plotting the reciprocals of the shrinkages $(S)^{-1}\times100$ gives a straight line relationship (Line II) with Xv. This relationship of shrinkage S versus Xv obtained for yarns of such differing $E_B$-values supports the view that the degree of SIC is the primary structural event and that the degree of stress-induced orientation (SIO) is only a secondary structural event in this range of $E_B$-values, with regard to determining the boil-off shrinkage S. A shrinkage S from about 50% (point a) to about 10% (point b), corresponding to a range of Xv of about 10 to 20%, is the preferred level of SIC for draw feed yarns, while less than about 10% shrinkage, corresponding to Xv greater than about 20%, is a preferred level of SIC for direct-use tensile yarns (b-c). Line II (plotting reciprocal values of S%,×100) provides an easier way to estimate Xv for hollow filaments of the invention having ($E_B$)-values in the approximate range of 120 to 40%, thus points a' and b' on line II, corresponding to points a and b on Line I, respectively, indicate a preferred level for draw feed yarns.
Figure 3B:
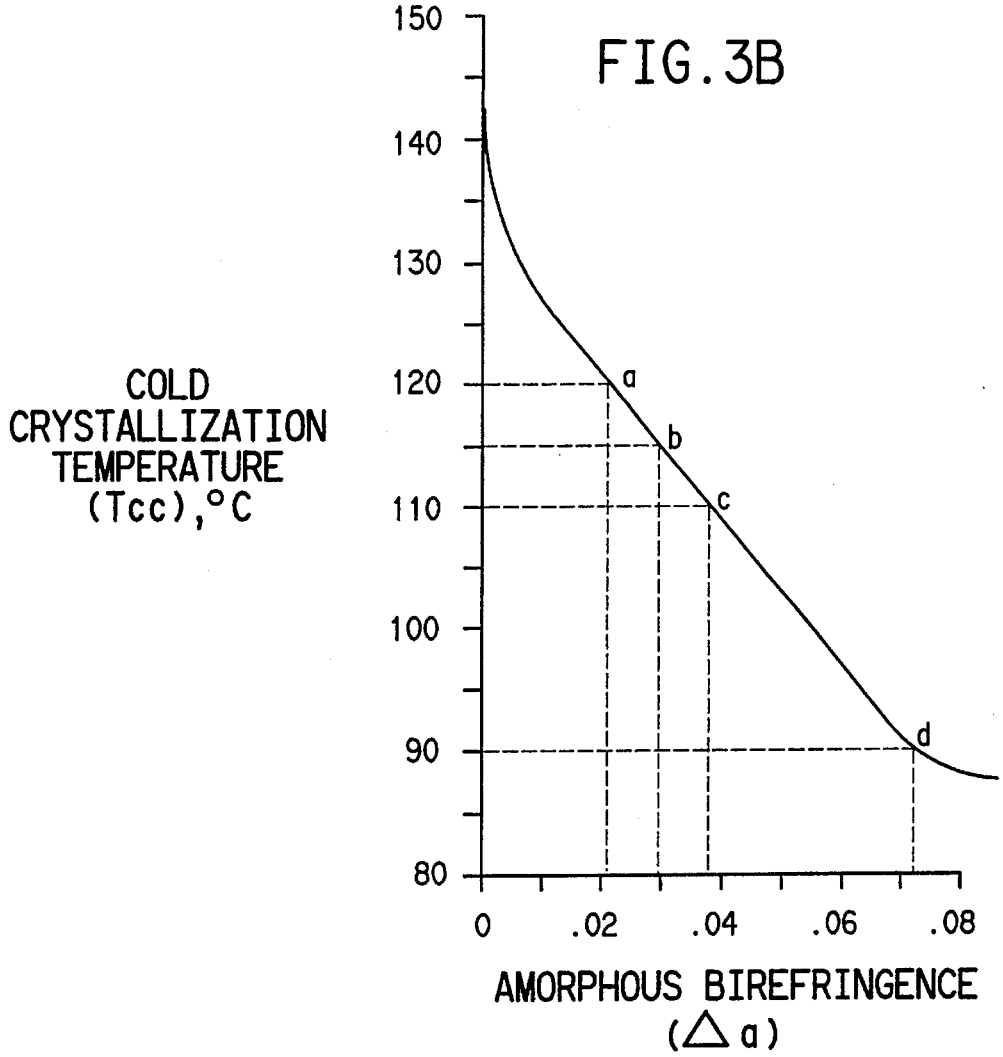
FIG. 3B is a representative plot of $T_{cc}$ (the peak temperature of "cold crystallization", as measured by Differential Scanning Calorimetry (DSC) at a heating rate of 20° C. per minute), versus amorphous birefringence, a measure of amorphous orientation (as expressed by Frankfort and Knox). For filaments for which measurement of birefringence is difficult, the value of $T_{cc}$ is a useful measure of the amorphous orientation. The filaments of the invention have values of $T_{cc}$ in the range of about 90° C. to 110° C.
Figure 3C:
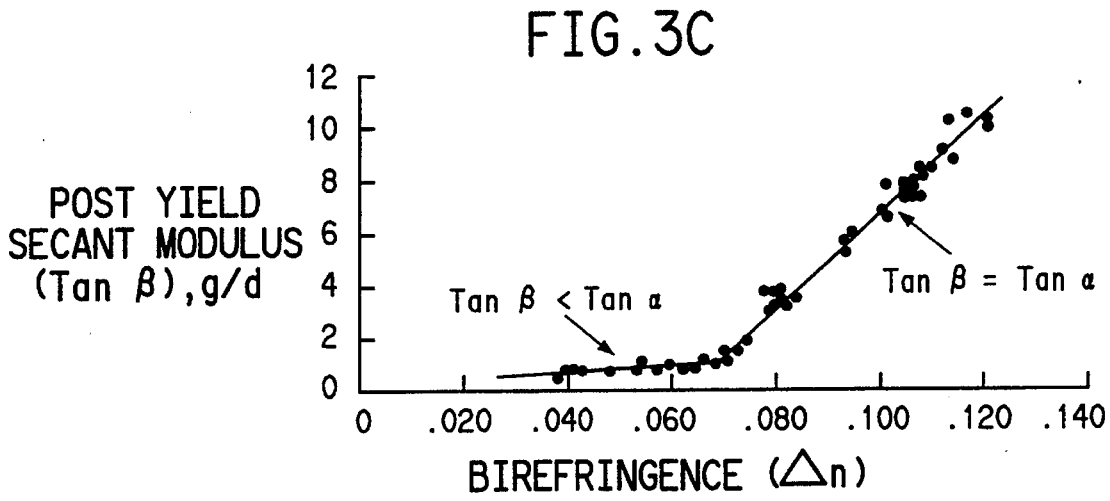
FIG. 3C is a representative plot of the post-yield secant modulus,Tan beta (i.e., "$M_{py}$"), versus birefringence. The $M_{py}$ herein is calculated from the expression $(1.20T_{20}-1.07T_7)/0.13$, where $T_{20}$ is the tenacity at 20% elongation and $T_7$ is the tenacity at 7% elongation. As may be seen, above about 2 g/d, the post-yield modulus ($M_{py}$) provides a useful measure of birefringence of spin-oriented, drawn, and textured filaments.

(refer to discussion of FIGS. 2 and 3A for additional details) .

Mixed-shrinkage hollow filament yarns may be provided by combining filament bundles of different shrinkages (S). At a given spin speed, shrinkage (S) decreases with decreasing dpf and increasing extrusion void area (e.g., increasing with increasing value of the ratio of the EVA and the spun dpf). Denier per filament is determined by capillary mass flow rates, $w=(V_S\times dpf)/9000$ (where $V_S$ is expressed in terms meters/minute and w in terms of grams/minute), through the spinneret capillary which is proportional to the capillary pressure drop, generally taken for solid round filaments and orfices, as being approximately proportional to $[(L/D)^n/D^3]$ that becomes $(L/D^4)$ for n of value 1 for Newtonian-like fluids, where L is capillary length and D is capillary diameter. For non round cross-sections, spun from short orifice capillaries as shown in FIGS. 4A and 5A, the value of $(L/D^4)$ is taken from that of the long metering capillary of high pressure that feeds the polymer into the shape determining exit orifice of low pressure drop compared to that of the metering capillaries. If this is not the case, then an "apparent" value of $(L/D^4)_a$ for the compound die (e.g., a multi-component die being comprised of exit orifice plate, exit orifice capillary, counterbore and the metering capillary) may experimentally be determined by co-extruding from the same metering source the capillaries forming the hollow filaments (H) with conventional round capillaries (R) of known $(L/D^4)_R$ such that an apparent $(L/D^4)_H$ for the hollow compound die is determined by the product of the ratio of spun filament deniers $[(dpf)_R/(dpf)_H]$ and the $(L/D^4)_R$-value; i.e., $[(dpf)(L/D^4)]_R/(dpf)_H$ for the co-extruded round filaments. Spinning hollow filaments from compound capillaries of differing $(L/D^4)_a$-values provides a simple route to mixed-denier hollow filament yarns. For example, if the different filaments (denoted as 1 and 2) are co-spun from the same spin pack of a single polymer metering source, then the capillary flow rates (w) will be approximately inversely proportional to $(L/D^4)_a$ of the different capillaries; e.g., $$(dpf)\times(L/D^4)_a]_1=[(dpf)\times(L/D^4)_a]_2;$$

and therefore, $$](dpf)_2/(dpf)_1]=[(L/D^4)_1/(L/D^4)_2]a.$$

A spinneret with metering capillaries of 15×72 mils and 8×32 mils, for example will provide filaments of mixed dpf in the ratio of 476.7 $mm^3$/86.5 $mm^2$=5.5 for polymers, using a value of the exponent of approximately 1. Experimentally the value of "n" for 2GT homopolymer is about 1.1 for the polymer LRV and process conditions used herein; but initially a value of 1 is used for "n" and the ratio of the capillaries $(L/D^4)$-values is used initially in making the mixed capillary spinnerets and then based on the experimentally measured dpf-values under the desired selection of process conditions, the value of "n" is calculated and the proper selection of the various L and D values are made to provide the goal dpf-ratio. For spinning filaments of different cross-section, but of the same dpf, it may be required that the metering capillaries be of slightly different dimensions so to overcome any small, but meaningful, differences in the pressure drop of the shape forming exit orifices. If spinning the different filament components from separate spin packs and combining them into a single mixed-filament bundle, for example; then the dpf of the filaments from a given spin pack is simply determined by the relation: dpf=9000 $w/(V_s\#_F)$, where w is the total spin pack mass flow rate and $\#_F$ is the number (#) of filaments (F) per spin pack.

Mixed-shrinkage yarns having the same dpf may be prepared by metering through segmented orifices of different extrusion void areas (EVA). For example, spinning 1.6 dpf at 3200 m/min with a 60 mil OD orifice capillary provides a shrinkage of 7.9%, and spinning 2.4 dpf under the same conditions provides a shrinkage of 22.6%. Spinning a 2.4 dpf with a 70 mil OD orifice capillary provides a shrinkage of 13.6, while spinning through a 50 mil OD orifice capillary provides a shrinkage of 35.6%. The dpf of the filaments are nominally the same when spinning with mixed extrusion void area (EVA)-spinnerets wherein the total pressure drop of the metering plate and extrusion orifice plate assembly is essentially determined by the significantly higher pressure drop of the common metering capillaries (L×D). In the above example, the absolute shrinkages, 13.6% and 35.6%, may be decreased while maintaining a shrinkage difference of at least 5% by decreasing the filament denier or by increasing spin speed. Hence, by selecting capillary extrusion area and dimensions of the metering capillaries, it is possible to cospin mixed-shrinkage hollow filaments of mixed-denier, or of the same denier for use as textile filament yarns or as draw feed yarns. To vary the filament-to-filament packing density, filaments of different denier and/or cross-sectional shapes may be used. The hollow filaments of the invention may also be combined with filaments without voids of different denier and/or cross-sectional shape as an alternative route to altering filament-to-filament packing density.

The invention lends itself to many variations, and advantages which are described briefly:

1. Reduced surface cyclic trimer (SCT) on the fiber, which reduces or even may eliminate oligomer deposits on the fabric during the cool down cycle of dyeing; SCT-values of less than 100 ppm are especially useful.

2. Use as a higher denier component in a mixed fine filament yarn (e.g., being comprised of a fine filament component of solid or hollow filaments of denier about 0.25 to about 0.75) to provide "stiffness" to the yarn of fine filaments for enhanced fabric "body" and "drape".

3. Combining high speed spun low shrinkage cationic dyeable polyester hollow filaments of the invention (e.g., such filaments having shrinkages less than about 10–12%) with acid-dyeable nylon filaments of comparable elongations to provide atmospheric carrier-free dyeable mixed-filament yarns with the polyester and nylon filaments capable of being dyed to different colors; and wherein the mixed-filament polyester/nylon yarns may be uniformly cold drawn for increased tensiles without losing dyeability; and also co-air-jet texturing, with or without drawing the low shrinkage polyester hollow filaments of the invention and the companion nylon filaments, to provide a bulky mixed-dyeable filament yarn.

4. High speed spinning of low LRV cationic-modified 2GT for uses where lower tensiles are preferred (e.g., for shearing, brushing, and napping), for improved pill-resistance vs. homopolymer of standard textile LRV values of about 21.

5. Selection of capillary dimensions, array, and polymer temperature/quench rates to produce filaments having the cross-section as represented by that of the "opens" in FIG. 1A—i.e., a similar to that of natural cotton.

6. Filaments characterized by $(1-S/S_m)>0.85$ and $T_7>1$ g/d and $E_B$ between about 40% to 90% may be uniformly co-drawn with nylon filaments (hollow or solid) wherein no loss in void content of either the polyester or nylon hollow filaments is observed.

7. Filaments characterized by high void content (>20%) and of low bending modulus $(M_B)$ such as to favor the formation of collapsed filament cross-sections, similar to that of "mercerized" cotton, during processes such as air-jet texturing, stuffer box crimping, and calendaring of the fabric during dyeing/finishing operations.

8. Mixed-filament yarns being comprised of filaments which differ in denier, void content, cross-sectional shape, and/or shrinkage so as to provide fabrics of different combinations of weight, volume, and rigidity (that may not be possible by single-type filament yarns, as discussed with reference to FIGS. 11–13 and in Example XXIV).

9. Spinning of high ID hollow filaments of odd cross-sections (such as hexalobal) such that, during air-jet (turbulent) type processes, the hollow filaments will "fibrillate" into micro-denier fibers of varying deniers and shapes. Caustic etching may be used to weaken the high ID filaments prior to such air-jet "thrashing" of the filament yarns.

10. Exposing the hollow filaments immediately after attenuation and while still hot to a caustic finish as described in U.S. Pat. No. 5,069,844 (Grindstaff and Reese) to increase the hydrophilicity of the filaments; e.g., more like cotton. Hydrophilicity can further be increased by selecting copolyesters with high mole percent of ether linkages (—O—) for example.

11. Combine low shrinkage hollow filaments with high shrinkage "solid" filaments, such that, on exposure to heat, the "solid" filaments are "pulled" into the core of the filament and thereby expose the hollow filaments at the surface for enhanced bulk.. Reducing the denier of the hollow filaments would further enhance the tactile aesthetics by providing softness and high bulk.

12. Combining homopolymer hollow filaments and cationic dyeable hollow filaments so as to provide mixed dyeing capability.

13. Prepare fabrics from air-jet or false-twist textured or self-bulking filaments and then brush and cut the surface filaments to expose their hollow ends which can then be caustic-treated, followed by additional brushing to provide a low cost "suede-like" fabric via the fibrillation of the caustic-treated exposed hollow filament ends.

Indeed, further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); capillaries may advantageously be made as described, for example, in (Kobsa et al) U.S. Pat. No. 5,168,193, and corresponding to EPA 0 440 397, published Aug. 7, 1991, and/or in (Kobsa) U.S. Pat. No. 5,259,753, corresponding to EPA 0 369 460, published May 23, 1990; finish application may be applied by convention roll application, metered finish tip applicators being preferred herein and finish may be applied in several steps, for example during spinning prior to drawing and after drawing prior to winding; interlace may be developed by using heated or unheated entanglement air-jets and may be developed in several steps, such as during spinning and during drawing and other devices may be used, such by use of tangle-reeds on a weftless sheet of yarns; interlace will generally not be used if the hollow filaments are intended for processing into tow and staple, in contrast to continuous filament yarns; conventional processing and conversion of tow to staple may be carried out as disclosed in the art.

TEST METHODS

Many of the polyester parameters and measurements mentioned herein are fully discussed and described in the aforesaid Knox, Knox and Noe, and Frankfort and Knox patents, all of which are hereby specifically incorporated herein by reference, so further detailed discussion, herein would, therefore be redundant.

For clarification, herein, S=boil-off shrinkage (the expression "$S_1$" being used in the Tables), $S_2$=DHS–S; and $S_{12}$=net shrinkage after boil-off followed by DHS; $T_B$ is the break tenacity expressed grams per "break" denier and is defined by the product of conventional textile tenacity and the residual draw-ratio defined by $(1-E_B/100)$; and $(T_B)_n$ is a $T_B$ normalized to 20.8 polymer LRV as defined by the product of $T_B$ and [(20.8/LRV) 0.75(1-% delusterant/100)$^{-4}$]. A Mechanical Quality Index (MQI) for the draw feed yarns is represented by the ratio of their $T_B$-values, $[(T_B)_D/(T_B)_U]$, where MQI-values greater than about 0.9 indicate the DFY and the drawing process of the DFY provided drawn yarns with an acceptable amount of broken filaments (frays) for downstream processing into textile structures.

Shrinkage Power. ($P_s$) referred to hereinbefore is defined by the product of the boil-off shrinkage S (%) and the maximum shrinkage tension $ST_{max}$ (g/d), $[ST_{max}\times S\%]$, where values of $P_s$ greater than about 1.5(g/d)% are preferred to overcome fabric restraints, especially for wovens. The ratio of the $ST_{max}$ to shrinkage S is referred to as the Shrinkage ModulUS. ($M_s$); i.e., $M_s=[(ST_{max}(g/d)S\%]\times 100\%$, where values less than about 5 g/d are preferred.

The values of the glass-transition temperature (Tg), the temperature at the onset of major crystallization ($T_c^o$), and temperature at the maximum rate of crystallization ($T_c$,max) may be determined by conventional DSC analytical procedures, but the values may also be estimated from the polymer's zero-shear melting point ($T_M^o$) (expressed in degrees Kelvin) for a given class of chemistry, such as polyesters using the approach taken by R. F. Boyer [Order in the Amorphous State of Polymers, ed. S. E. Keinath, R. L. Miller, and J. K. Riecke, Plenum Press (N.Y.), 1987]; wherein, $Tg=0.65\ T_M^o$; $T_c^o=0.75T_M^o$; $T_{c,max}=0.85\ T_M^o$; and the initial crystallization occurs at the mid-point between $T_c^o$ and $T_g$; that is about 0.7 $T_M^o$ which correlates with the shrinkage tension peak temperature $T(ST_{max})$ of as-spun filaments; and wherein all the above calculated temperatures are expressed in degrees Kelvin (where degrees Kelvin K=degrees centigrade C+273). The onset of major crystallization ($T_c^o$) is also associated, herein, with the temperature where the rate of crystallization is 50% of the maximum rate and $T_c^o$ is also denoted by Tc,0.5. New test methods used herein for percent void content (VC), percent surface cyclic trimer (SCT) and heat transfer (Clo-value) are summarized below.

The Surface Cyclic Trimer (SCT) is measured by extracting out the SCT, using about 25 ml of spectrograde carbon tetrachloride per 0.5 grams of fiber, and measuring the amount of solubilized SCT from the absorbance of the extracted solution at 286 nm. (calibrate opposite a solution of approximate 2.86 mg of trimer dissolved in 25 ml (0.1144 mg/ml). Using several dilutions of the control solution and measuring the absorbance at 286 nm provide linear calibration plot of ppm trimer vs. absorbance. The calibration curve is now used to determine the ppm of SCT for the desired fiber sample.) The absorbance may be measured using a Cary 17 Spectrophotometer and standard 5 ml silica cells.

Hollow filaments are measured for their void content (VC) using the following procedure. A fiber specimen is mounted in a Hardy microtome (Hardy, U.S. Department of Agriculture circ. 378, 1933) and divided into thin sections according to methods essentially as disclosed in "Fibre Microscopy its Technique and Application by J. L. Stoves-.(van Nostrand Co., Inc., N.Y. 1958, pp. 180–182). Thin sections are then mounted on a SUPER FIBERQUANT video microscope system stage (VASHAW SCIENTIFIC CO., 3597 Parkway Lane, Suite 100, Norcross, Ga. 30092) and displayed on the SUPER FIBERQUANT CRT under magnification up to 100×, as needed. The image of an individual thin section of one fiber is selected, and its outside diameter is measured automatically by the FIBERQUANT software. Likewise, an inside diameter of the same filament is also selected and measured. The ratio of the cross-sectional area of the filament void region to that of the cross-sectional area surrounded by the periphery of the filament, multiplied by 100, is the percent void (VC). Using the FIBERQUANT results, percent void is calculated as the square of the inside diameter divided by the square of the outside diameter of the each filament and multiplied by 100. The process is then repeated for each filament in the field of view to generate a statistically significant sample set of filament void measurements that are arranged to provide value for VC.

CLO values are a unit of thermal resistance of fabrics (made, e.g., from yarns of hollow fibers) and are measured according to ASTM Method D 1518-85, reapproved 1990. The units of CLO are derived from the following expression: CLO=[thickness of fabric (inches)×0.00164]×heat conductivity, where: 0.00164 is a combined factor to yield the specific CLO in (deg K) (sq. meter)/Watt per unit thickness. Typically, the heat conductivity measurement is performed on a samples area of fabric (5 cm by 5 cm) and measured at a temperature difference of 10 degrees C under 6 grams of force per square cm. The heat conductivity (the denominator of the expression above) becomes: heat conductivity=(W×D)/(A×temperature difference), where: W (watts); D (sample thickness under 150 grams per sq. cm); A (area=25 sq. cm); temperature difference=10 degrees C.

Air permeability. is measured in accordance with ASTM Method D 737-75, reapproved 1980. ASTM D 737 defines air permeability as the rate of air flow through a fabric of known area (7.0 cm diameter) under a fixed differential pressure (12.7 mm Hg) between the two fabric surfaces. For this application, air permeability measurements are made on a sampled area approximately equal to one square yard or square meter of fabric which are normalized to one square foot. Before testing, the fabric is preconditioned at 21°±1° C. and 65±2% relative humidity for at least 16 hours prior to testing. Measurements are reported as cubic feet per minute per square foot (cu ft/min/sq ft). Cubic feet per minute per square foot can be converted to cubic centimeters per second per square centimeter by multiplying by 0.508.

Various embodiments of the processes and products of the invention are illustrated by, but not limited to, the following Examples with details summarized in the Tables. Items denoted by "C" are generally "Comparisons" that are not according to the invention, for example item "1C" being filaments in which the void content was significantly reduced; that is, having $(VC)_D/(VC)_{UD}$)-values less than about 0.9 on subsequent drawing. In Tables 1 through 8, the boil-off shrinkage S is denoted by S1; the maximum shrinkage potential $S_m$ is denoted by $S_{max}$; the tenacity-at-7% elongation ($T_7$) is denoted by T(7%), tenacity based on original undrawn denier is sometimes denoted by the abbreviation "TEN", elongation-to-break by $E_b$ and initial modulus by "MOD.". The spinneret capillary OD is expressed in mils (where there are 0.0254 mm/mil). Spin Speed, as defined as the speed of the first driven roll is expressed in both ypm and mpm. The peak shrinkage tension (STmax) is expressed in units of mg/d (where g/d×1000 =mg/d) and the peak shrinkage temperature is denoted by T(ST) in degrees centigrade (C). The polymer type is denoted by "HO" for homopolymer 2GT polyester and by "CO" for 2GT modified with 1–3 mole percent of ethylene-5-Na-sulfo-isophthalate. In Tables 6 and 7, the draw-ratio is denoted by the abbreviation DR; hence, with a winding speed of 400 mpm and a DR of 1.54, the take-off speed is defined by 400/1.54=259 mpm. The abbreviation N/A denotes the data is not available for that particular test item. Temperatures T1, T2, and T3 are described in Example IV.

EXAMPLE I

Hollow filament yarns spun from 2GT homopolymer (HO) of nominal 19.7 LRV and with a nominal 254 C $T_M{}^o$; and from 2GT copolymer (CO) of nominal 15.3 LRV, of nominal 250 C $T_M{}^o$, and modified with 2 mole percent ethylene 5-sodium sulfo isophthalate for cationic dyeability. The hollow filaments were spun using 15×72 mil (0.381×1.829 mm) metering capillaries and orifice capillaries similar to those illustrated in FIG. 5A with a symmetric counterbore entrance angle (S+T) of 60 degrees, wherein S=T, an extrusion void area (EVA) of 1.37 $mm^2$ with an EVA/EA ratio, $[(60-2\times4)/(60)]^2$ of 0.75 for an arc segment rim widths (W) of 4 mils (0.10 mm) and orifice capillary length of 5 mils (0.127 mm) to give a L/W-value of 1.2. The polymer melt temperature ($T_P$) was typically about 290–293° C. and the freshly extruded filaments were protected from cooling air by a 2.5 cm delay tube and then quenched via radially directed air flow of nominal 10 to 30 mpm and converged into multi-filament bundles via metered finish tip guide applicators at a distance about 100–115 cm from the spinneret. The converged filament bundles were withdrawn at spin speeds ($V_S$) between 2286 and 4663 mpm (2500 and 5000 ypm), interlaced and wound in the form of spin packages. The polymer mass flow rate w [=(dpf×VS)/9000, g/min] was varied to provide filament deniers between 1.8 and 5. The percent void content (VC) was determined from the expression: VC, %=[(1−(ID/OD)2]×100%, where ID and OD were measured from filament cross-sections using the FIBERQUANT Method, described hereinbefore. The tensiles and shrinkage properties were measured for 26 such yarns and are summarized in Tables 1 and 2.

EXAMPLE II

In Tables 3 and 4, data are summarized for hollow filament yarns spun essentially as described for Example I, but wherein the extrusion void area was varied from 0.89 $mm^2$ to 1.36 $mm^2$ to 1.94 $mm^2$, corresponding to orifice capillary ODs of 50, 60, and 70 mils (1.2 mm, 1.44 mm, and 1.68 mm), respectively, with 4 mil (0.10 mm) segment rim width. In general, percent void content increases with EVA; however, as the denier per filament is decreased from 5 to 2.4, it is preferred to select spinnerets of lower EVA to provide for comparable spinning performance (i.e., comparable attenuation ratio, $[EVA/(dpf)_s]$. For example, a 5 dpf filament spun with a 70 mil (1.778 mm) OD capillary and a 1.94 $mm^2$ EVA has a melt attenuation ratio $[EVA/(dpf)_s]$ of (1.94/5)=0.39. Decreasing dpf to 2.4 with the same capillary yields an $[EVA/(dpf)_s]$ of (1.94/2.4)=0.895. To provide a 2.4 denier filament with a similar $[EVA/(dpf)_s]$ value as that of the 5 dpf filament (using 70 mil (1,778 mm) OD capillary), the 2.4 filament could be spun using capillary having an OD of about 50 mils (about 1.27 mm). Although the $[EVA/(dpf)_s]$ values of the 2.4 and 5 dpf processes are approximately the same when spinning from 50 and 70 mil 0D capillaries with a 4 mil arc (rim) width, respectively, the void content of the 5 dpf filaments is 20% as compared to 13.4% for the 2.4 dpf filaments. This reduction in void content may be considered unacceptable for certain end-use needs. By selecting an intermediate OD capillary with an OD of 60 mils (1.524 mm) and increasing spin speed from 3200 m/min to 4115 m/min provides 2.4 dpf hollow filaments of comparable void content to the 5 dpf filaments spun at 3200 m/min. The process of the invention provides the capability to balance the need for acceptable spinning operability (indicated by the value of $EVA/(dpf)_s$]) and the need for fine dpf filaments of high void content.

EXAMPLE III

These yarns of the invention were made with different process conditions and spinning hardware, as indicated in Table 5. In Table 5, items 1 to 3 were spun with cross-flow quench (XF) fitted with a 10 cm delay tube and 4 to 6 were spun with a radial quench (RAD) fitted with a 2.5 cm delay tube. Filaments spun with radial quench were in general of high void content than those spun with cross-flow quench.

From numerous multi-variable tests, it is observed that the void content (VC) decreases with increasing polymer temperature $T_P$, decreasing polymer LRV, decreasing dpf, decreasing quenching air flow rate (i.e., hotter during attenuation), decreasing EVA, and decreasing spin speed. The effect of orifice capillary dimensions; e.g., (S/T) and (L/W) ratios were measured for a nominal 1–1.2 dpf filament spun at 2500 ypm (2286 mpm). The percent void content (VC)

increased with both (S/T) and (L/W) ratios and with the product [(S/T)(L/W)].

EXAMPLE IV

A total of 34 yarns of the invention and comparisons (not of the invention and designated by "C") were drawn under varying conditions, where temperatures T1, T2, and T3 refer to draw zone, 1st heat set zone, and to 2nd heat set (relax) zone, respectively, as set out in Tables 6 and 7. Such drawing and heat treatments may be carried out on a weftless warp sheet prior to knitting, weaving, or winding onto a-beam. Undrawn filament yarns characterized by elongations ($E_B$) in the range of about 40 to about 160% and by (1-S/Sm)-values greater than about 0.4 (e.g., with S-values less than about 50%) may be drawn without significant loss in void content. Hollow filaments with $E_B$ and ($1-S/S_m$) values outside of the preferred ranges may be drawn without loss in void content, but selection of drawing and post heat treatment conditions is found to be significantly more critical than for filaments of the invention. Over drawing the filaments of the invention, e.g., to elongations ($E_B$) less than about 20%, especially less than about 15%, reduces the void content. Drawn hollow filaments have elongations about 15% to about 40%, preferably about 20% and 40%, and for drawn yarns prepared from crystalline "feed" yarns and/or from feed yarns wherein the polymer contains chainbranching agents and/or of strong Lewis acid-base bonds (e.g., ethylene 5-sodium sulfo isophthalate), then the elongation of the drawn yarns may be increased beyond 30–40% with less deterioration in uniformity than homopolymer.

EXAMPLES V TO VIII

Undrawn hollow filaments of the invention were spun using different types of capillary design and arrays, as follows. Example V used spinnerets as described in FIGS. 4A,B with an (S+T) of 42.5 degrees and S/T-ratio of 1.83; and of 24 mil (0.610 mm) OD and a 19 mil (0.483 mm) ID to provide an EVA of 0.183 $mm^2$ and a EV of 0.292 $mm^2$. In Example VI spinnerets with counterbores of a 1.83 (S/T)-ratio were used as in Example V; except the OD was increased to 29.5 mils (0.749 mm) and the ID was increased to 24.5 mils (0.622 mm) to provide an extrusion void area of 0.304 $mm^2$ and [EVA/$(dpf)_s$]-ratio of 0.22 to 0.55 with a (EVA/EV)-ratio of 0.71. Example VII uses the same capillaries as Example V except the 100 capillaries were arranged in a 2-ring array while Example V used a 5-ring array. Example VIII used the same spinnerets as described for Example VII except that the counterbore entrance angle (S/T)-ratio was reduced from 1.83 to 1.17 and the total entrance angle (S+T) was increased from 42.5 to 51 degrees.

These Examples V to VIII demonstrated that increasing the (S/T)-ratio increased void content, but with a slight deterioration in along-end uniformity. For a given (S/T)-ratio of 1.83, the percent void content was higher for the 2-ring array than the 5 ring array which suggests that the average ambient temperature of the freshly-extruded filaments remained hotter longer in the 5-ring array vs. the 2 ring array. These Examples V through VIII emphasize the need for careful selection of process parameters for higher void content while balanced against a need to provide uniformity and mechanical quality.

EXAMPLE IX 100-hole spinnerets with a 5-ring array were used to spin 0.6 to 1.2 dpf hollow filaments in Example IX, using spinnerets having a 24 mil (0.610 mm) OD and 19 mil (0.483 mm) and configured with a 4:1 (L/W)-ratio orifice capillary and reservoir type counterbore as depicted in FIG. 6A. Example IX may be compared to Example VIII wherein the (L/W)-ratio is about 1.2 and has a cone-like counterbore with a (S/T)-ratio of 1.83 and a [(S/T)(L/W)] product of 2.2 as compared to a [(S/T)(L/W)] product of 4 for this example. The void content of filament spun with spinnerets of higher [(S/T)(L/W)]-values is greater than filaments spun with spinnerets of lower [(S/T)(L/W)]-values. The increase in void content is not linear with [(S/T)(L/W)]-values, but is expected to increase and then level-off as equilibrium melt flow and die-swell are obtained (i.e., wherein the capillary Bagley "end-effects" are minimized).

EXAMPLE X

The % "Opens" were measured for the different capillary arrays of Examples V through VIII. As expected, as the denier per filament is reduced the % opens increases. The array design has a significant effect on % opens. For example, with a 2-ring array of 100 filament, the % opens increased from <5% for 1.12 dpf filaments to 73% for 0.5 dpf filaments. A 3-ring array reduced the % opens for the 0.5 dpf filaments to 10–15%. By increasing the orifice capillary length (L) to arc width (W) ratio from about 1.2 to 4 (refer to Example IX), the % opens were further reduced to <5% for the 0.5 dpf filaments. A preferred array is one that permits radially directed air to quench filaments in different rings as equally as possible by slightly staggering each ring of capillaries slightly with respect to one another so as to enable the inner rings to be quenched as uniformly as possible with minimum interference by the outer rings so to provide for higher void content and better along end denier uniformity.

COMPARISON XI

The percent void content (VC) was measured for a hollow filament yarn with an elongation of 141% providing a shrinkage potential ($S_m$) of 74% and a ($1-S/S_m$)-value less than 0.4, to illustrate the loss in void content on drawing for hollow filaments of insufficient SIC. The undrawn 1.2 denier filament yarns had void content of 18.4% which reduced to 16.4% on drawing to a 43% $E_B$ and to a void content of 12.8% on drawing to a 25.2% $E_B$.

EXAMPLE XII

Figure 7:
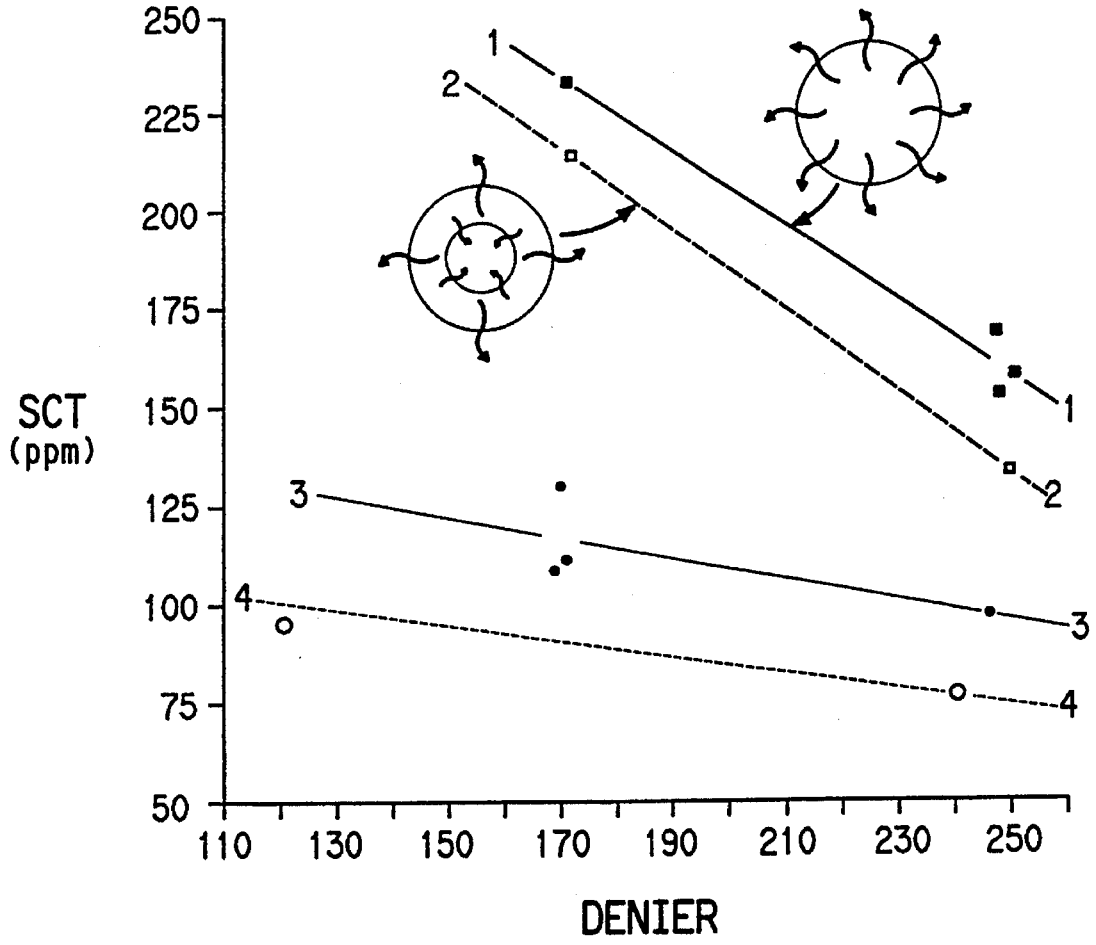
FIG. 7 shows 4 lines plotting amounts of surface cyclic trimer (SCT) measured in parts per million (ppm) versus denier of 50-filament yarns spun as follows: Lines 1 and 2 were spun at 2500 ypm (2286 mpm) without voids and with voids, respectively; Lines 3 and 4 were spun at 3500 ypm (3200 mpm) without voids and with voids respectively. The SCT is observed to decrease with denier per filament and to decrease with spin speed (i.e., extent of SIC). The insert schematics illustrate possible diffusion paths for the SCT and thereby the observed lower SCT for the hollow filaments of the invention. Preferred hollow filaments have SCT-levels of less than about 100 ppm.
Figure 8:
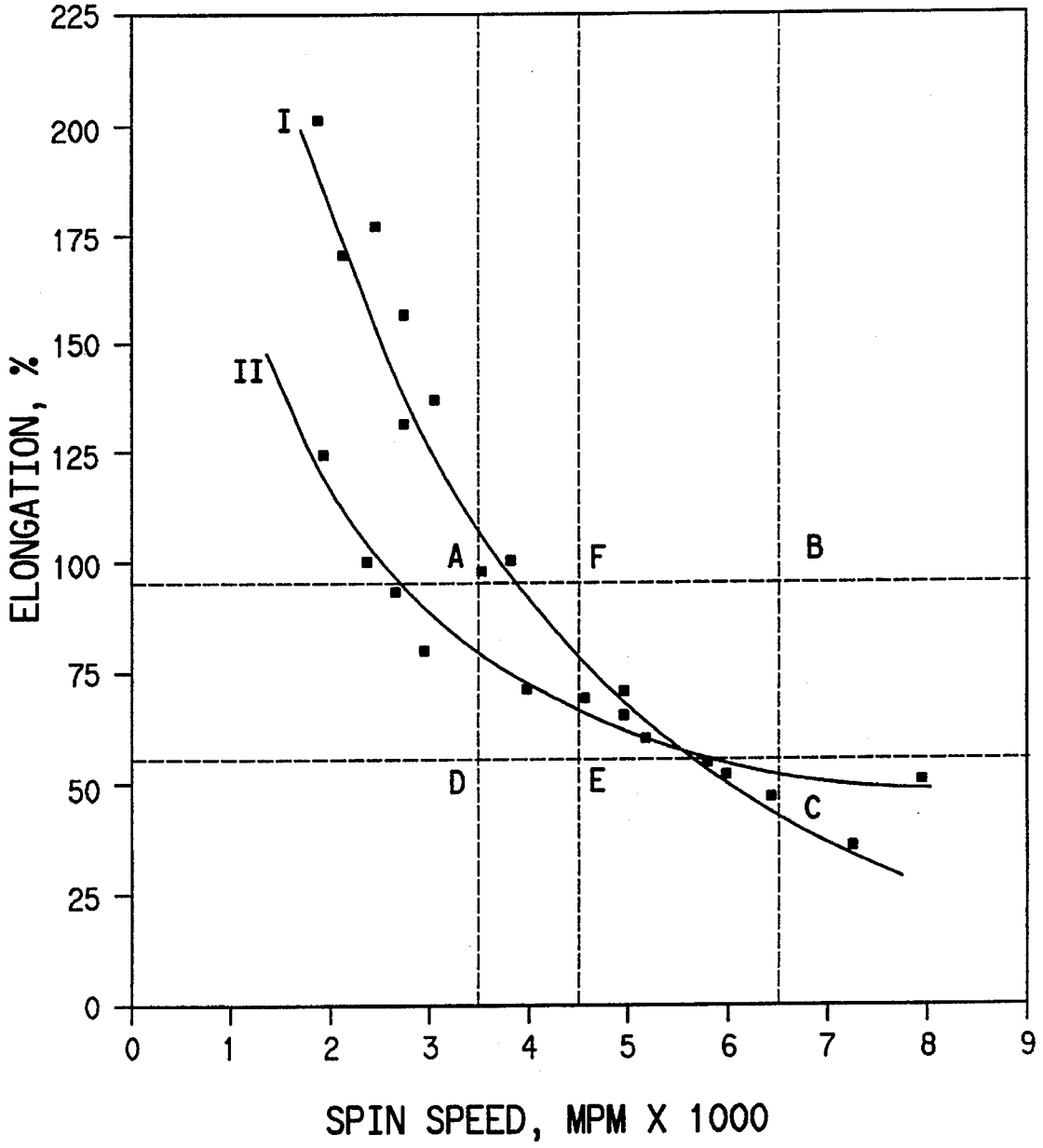
FIG. 8 is a representative plot of percent elongations-to-break ($E_B$) of spin-oriented undrawn nylon (II) and polyester (I) versus spinning speed. Between about 3.5 Km/min and 6.5 Km/min (denoted by region ABCD) and especially between about 4.5 and 6.5 Km/min (denoted by region BCEF), the elongations of undrawn polyester and nylon filaments are of the same order. The elongation of the undrawn nylon filaments may be increased by increasing polymer RV (Chamberlain U.S. Pat. No. 4,583,357 and 4,646,514), by use of chain branching agents (Nunning U.S. Pat. No. 4,721,650), or by use of selected copolyamides and higher RV (Knox et al U.S. Pat. No. 5,136,666). The elongation of the undrawn polyester may be increased by lower intrinsic viscosity and use of copolyesters (Knox U.S. Pat. No. 4,156,071 and Frankfort and Knox U.S. Pat. Nos. 4,134,882 and 4,195,051), and by incorporating minor amounts of chain branching agents (MacLean U.S. Pat. No. 4,092,229, Knox U.S. Pat. No. 4,156,051 and Reese U.S. Pat. Nos. 4,883,032, 4,996,740, and 5,034,174). The elongation of polyester filaments is especially responsive to changes in filament denier and shape, with elongation decreasing with increasing filament surface-to-volume (i.e., with either or both decreasing filament denier and non-round shapes).
Figure 9:
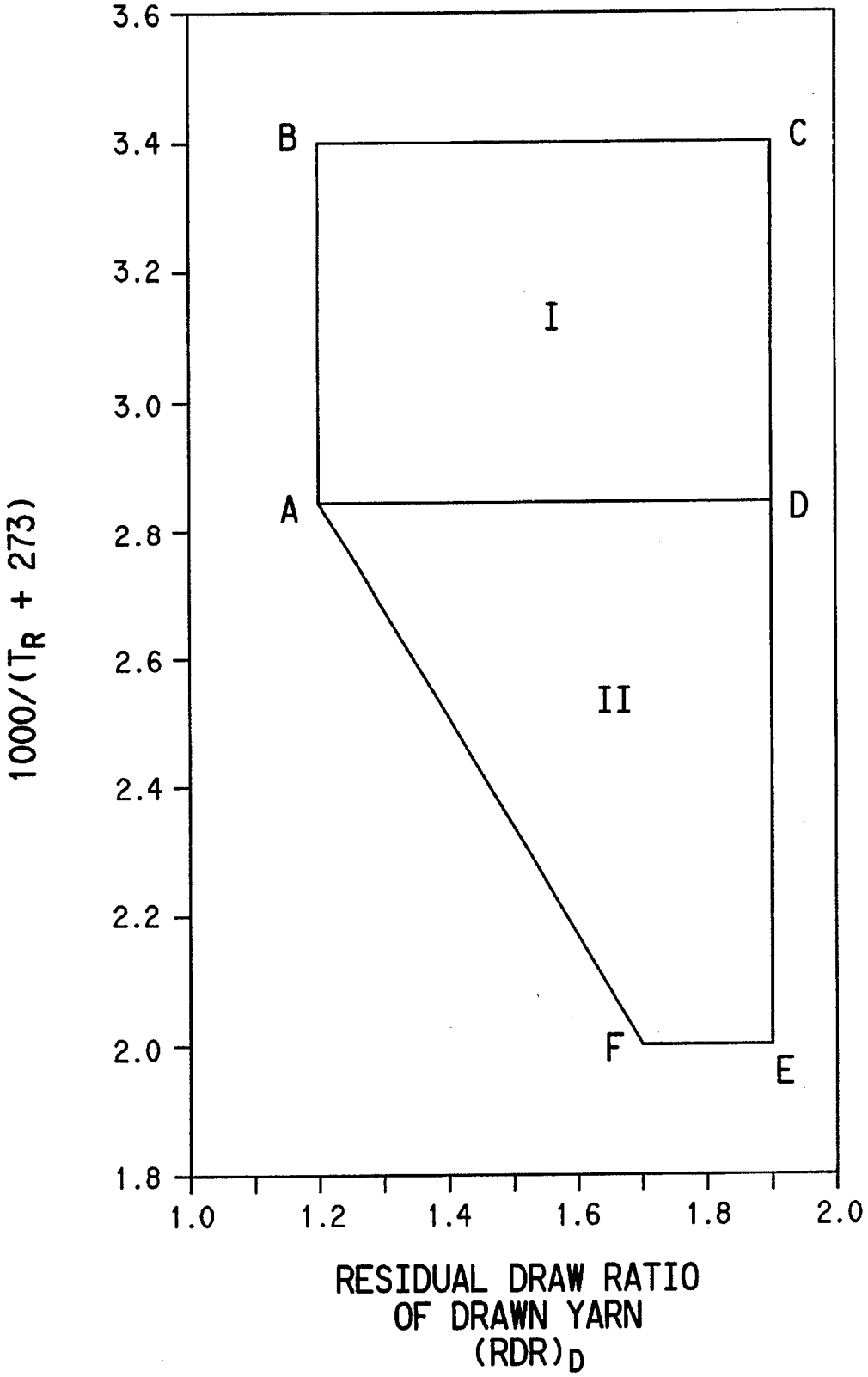
FIG. 9 shows the relationship between the relaxation/heat setting temperature ($T_R$, in degrees C.) and the residual draw-ratio of the drawn yarns $(RDR)_D$ for nylon 66 graphically by a plot of $[1000/(T_R+273)]$ vs. $(RDR)_D$ as described by Boles et al in PCT/US91/04244 (Jun. 21, 1991). Drawn filaments, suitable for critically dyed end-uses are obtained by selecting conditions met by the regions I (ABCD) and II (ADEF) in this FIG. 9. Acceptable along-end dye uniformity is achieved if the extent of drawing and heat setting are balanced as described by the relationship: $1000/(T_R+273)>/=[4.95-1.75(RDR)_D]$. This relaxation temperature vs. $(RDR)_D$ relation is also applied when co-drawing and heat relaxing or heat relaxing previous drawn and co-mingled mixed-filament yarns, such as co-drawn mixed-filament yarns, such as nylon/polyester filament yarns.

The amount of surface cyclic trimer (SCT), a common problem with many fibers of 2GT-polymer, was measured for yarns spun at 2500 ypm (2286 mpm) and at 3500 ypm (3200 mpm) over a wide denier per filament range. The amount of SCT was compared to solid filaments spun using similar conditions. The amount of SCT was found to decrease with increasing spinning speed and to increase with decreasing dpf. This suggests that increasing spinning speeds is a preferred route to provide hollow filaments of low dpf with low SCT, e.g., less then 100 ppm. (Refer to discussion of FIG. 7 for additional details).

EXAMPLE XIII

The effect of draw temperature $T_D$) and set temperature on representative polyester spun filaments is shown in Table 80. It was observed that drawing at temperatures ($T_D$) above the polymer Tg (about 65°–70° C. for 2GT) and less than about the onset of major crystallization $T_c^o$ (about 140°–150° C. for 2GT) provided shrinkages S greater than 10%, while drawing above $T_c^o$ reduced shrinkage to about 5%. The data suggest that the degree of shrinkage of drawn polyester filaments may be "tailored" for a given end-use and to make possible a simple route to drawn mixed-shrinkage filament yarns. This process can equally be applied to draw-warping, draw airjet texturing, and draw stuffer-box texturing.

EXAMPLE XIV

Mixed-shrinkage multi-filament yarns were prepared by spinning 50-filament yarns of nominal 21 LRV polymer at 285° C.; quenching the filaments with a radial quench of a 1.25 inch (3.17 cm) delay; converging the filaments at a distance of about 110 cm using a metered finish tip applicator and withdrawing the spun filaments at a spin speed of 2800 ypm (2560 mpm). The mixed-filament yarn had an average dpf of 2.36, a $T_7$ of 0.56 g/d, an elongation of 142% (corresponding to a $S_m$ value of 74%), a shrinkage S of 42.7%, a $(1-S/S_m)$-value of about 0.42, and a tenacity of 2.5 g/d. The measured average void content was 13% for the dpf filaments comprising the 50 filament yarn bundle. The differential dpf was achieved by using different $(L/D^4)$-values for the metering capillaries. The orifice capillaries were all characterized by a 29.5 mil (0.749 mm) OD, a 24.5 mil (0.622 mm) ID, an orifice capillary (L/W)-ratio of 1.4, (S/T)-ratio of 1.83 for (S+T) of 42.5 degrees. The metering capillaries for the high (2) dpf filaments were 20×75 mils (0.508×1.905 mm) providing a (L/D4)-value of 28.6 $mm^{-3}$; and the metering capillaries of the low (1) low dpf filaments were 15×72 mils (0.381×1.829 mm) providing a (L/D4)-value of 8.7 $mm^{-3}$ and a ratio of $[(L/D^4)_1/(L/D^4)_2]$ of 3.3; i.e., similar to that of the individual filament deniers, $[(dpf)_2/(dpf)_1]$. Drawing the mixed-denier filaments according to the process summarized in Example XIII provides a simple route to mixed-shrinkage multihollow filament yarns.

EXAMPLE XV

Hollow filaments of different deniers, but of similar shrinkage, are prepared by selecting orifice capillaries of different apparent $(L/D^4)_a$-values where filament denier is taken to be inversely proportional to the orifice capillary $(L/D^4)_a$-value; that is, $[(dpf)(L/D^4)_a]_1=[(dpf)(L/D^4)_a]_2$, giving $[(dpf)2/(dpf)_1]=[(L/D^4)_1/(L/D^4)_2]_a$. The apparent $(L/D^4)_a$-value for the compound hollow extrusion dies (i.e., being comprised of an orifice capillary, counterbore, and usually a metering capillary) is determined experimentally by co-extruding hollow filaments from compound dies characterized by $(L/D^4)$H-values and round solid filaments from simple round (R) cylindrical capillaries of known $(L/D^4)$R-values and solving for $(L/D^4)_H$ from measured filament deniers and $(L/D^4)_R$-values; that is, $(L/D^4)_H$ of the compound dies for spinning of the hollow (H) filaments is determined from the relationship $(L/D^4)_H=[(dpf)_R/(dpf)_H](L/D^4)_R$. From knowing the $(L/D^4)$H-values for different hollow filament dies, a selection may be made so to spin hollow filaments (1 and 2) of different deniers where, as shown above, the ratio of co-extruded filament deniers to be inversely proportional to $(L/D^4)_H$-values from which the filaments were extruded. It is expected that the higher denier hollow filaments (2) to have higher shrinkage S than the lower denier hollow filaments (1); however to obtain filaments (1) and (2) differing in dpf of equal shrinkage, extrusion dies of different EVA-values are selected where shrinkage S is found to vary inversely with EVA-values of the extrusion dies. The void content of the high denier filaments (2) spun from the larger dies (higher EVA) is greater than the low denier filaments (1) spun from smaller dies (lower EVA). To offset the difference in void content (VC), if desired, the lower denier filaments may be spun from compound dies having a larger [ (S/T)(L/W)] product; that is, so that $[(W_{ext})_a]_1=[(W_{ext})_a]_2$, wherein $(W_{ext})_a$ may be expressed by $(k[LRV(T_m^o/T_P)^6 V_s^2][dpf (EVA)^{1/2}])^n$ and the value of $k[LRV(T_m^o/T_P)^6 V_s^2]$ for the high (2) and low (1) denier filaments is taken to be equal and thereby giving $[(dpf)(EVA^{1/2})^n]=[(dpf)(EVA)^{1/2}]^n]_2$ for spinning filaments of different denier (dpf) but of similar void content. After selecting dpf values and corresponding ID-values to minimize differences in shrinkage S between filaments (1) and (2), the values of $n_1$ and $n_2$ may be used to reduce differences in the VC of filaments (1) and (2) (if desired); that is through selection of (S/T) and/or (L/W) of the extrusion dies used to spin filaments (1) and (2), wherein the void content may be increased by either increasing (S/T) and/or (L/W). Increasing (S/T) of filament (1) will provide the higher void content of these finer filaments; however, increasing (L/W) of filament 1 will provide mixed results; that is, higher (L/W)-values will increase void content via increased die-swell but will also increase the apparent $(L/D^4)_a$-value and in turn decrease the filament denier and in offset the gains in void content through higher (S/T)-values. In this situation, the apparent $(L/D^4)_a$-values of filament 1 may be maintained at the desired value to provide the desired filament dpf by reducing the $(L/D^4)_a$-value contribution of the metering capillary to the $(L/D^4)_a$-value of the compound die of filament (1). The process of the invention provides a process rationale for obtaining desired values of filament dpf, shrinkage, and void content.

Figure 1C:
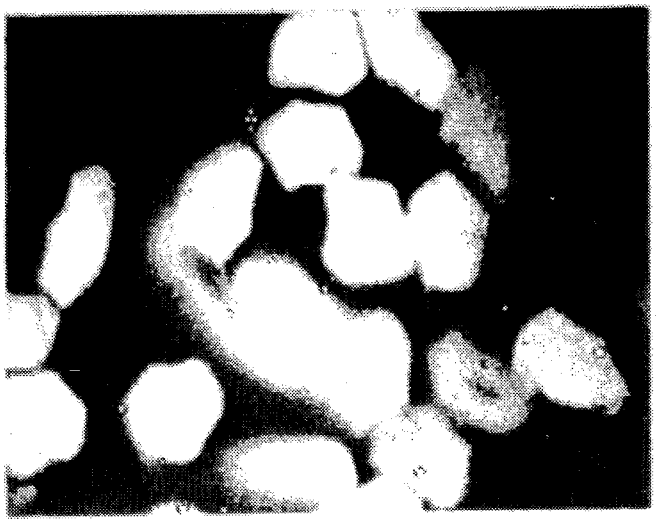

EXAMPLE XVI 70 to 120 denier 100-filament yarns of the invention were false-twist textured at 400 mpm using a draw-ratio of 1.506 with a D/Y-ratio of 1.707 at a draw temperature of 160° C. which significantly lower than that of conventional false-twist texturing. The 120 denier textured yarns have a nominal denier of 81.4, 46.0 g/d modulus, 1.93 g/d $T_7$, 3.44 g/d tenacity, 27.4% elongation, and a 4.2% shrinkage S. The voids collapsed on texturing to provide irregular cotton-like cross-sections (except a finer cross-section than that of cotton) as illustrated in FIG. 1C. The percent broken filaments as measured by using a commercial Fray counter shows that broken filaments increase as dpf decreases; especially below 1 dpf.

EXAMPLE XVII

A nominal 4 dpf 50-filament spun yarn of nominal values of 125% elongation, 0.53 g/d $T_7$, 1.7 g/d tenacity, 19 g/d modulus, and of 15% void content was draw air-jet textured at 330 mpm on a Barmag FK6T-80 air-jet texturing machine using a 1.64 draw-ratio, with T1/T2/T3 zone temperatures of 155° C./155° C./225° C. and a jet using 135 psi (46 $kg/cm^2$) pressure to provide a bulky yarn of nominal 3.6 dpf 50-filament yarn of 37.5% elongation, 1.35 g/d $T_7$, 2.84 g/d tenacity (and providing a MQI of 1.02), 38.9 g/d modulus, and an average void content of 17.3%.

EXAMPLE XVIII

A 105 denier 50-filament cationic dyeable polyester feed yarn was melt spun at 290° C. with 15.2 LRV polymer of 2GT modified with 2% ethylene 5-(sodium-sulfo) isophthalate) at 2800 ypm (2560 mpm) and quenched using radially directed air with a 3-inch (7.62 cm) delay. The orifice capillary used is characterized by a 40.6 mil (1.03 mm) OD and a 34.2 mil (0.87 mm) ID and a (L/W)-ratio of about 1.7 and a (S/T)-ratio of 1 with (S+T) of 45 degrees and a 15×72 mil (0.381×1.829 mm) metering capillaries providing an average 18.3% void content. Yarn quality was excellent with a 1.9% denier spread, less than 1% opens. The spun yarns had a nominal 0.74 g/d $T_7$, 21.3 g/d modulus, 106.6% elongation, and 1.7 g/d tenacity. The maximum shrinkage tension $ST_{max}$ was 0.05 g/d (50 mg/d) at a 83° C. peak temperature $T(ST_max)$. The yarn was spun with 1.3% finish and a RPC of 6 for use as a warp draw feed yarn. The spun feed yarns were co-mingled to give 100-filament yarns which were then warp drawn "cold" at 600 mpm using a 1.5 nominal draw-ratio and heat set at 180° C. to provide nominal 152.2 denier yarns (in the form of a weftless warp sheet) of 36.6% residual elongation and 2.4 g/d tenacity (and providing a MQI of 0.93) and a 6.1% shrinkage S for use in weaving, and were partially drawn to a residual elongation of 52.1% for use as a knitting yarn. The denier spread of the later 52% $E_B$ drawn yarns was about 25% higher than the drawn yarns of 36% residual elongation, and was considered acceptable for that particular end-use but in general EB-values of 30–40% are preferred. The strong Lewis acid-base bonds formed with the incorporation of 2% ethylene 5-(sodium-sulfo) isophthalate) provide more uniform drawing at a given residual elongations than 2GT homopolymer POY as taught by Knox and Noe in U.S. Pat. No. 5,066,427.

EXAMPLE XIX

Drawn yarns (similar to those prepared by the split process of Example XVIII) were prepared in a coupled process by spinning at 2500 ypm (2286 mpm), drawing 1.4× and winding up at 3500 ypm (3200 mpm) a drawn yarn characterized by a 36.3% elongation, 2.4 g/d tenacity, 1.7 g/d T7, 6.1% shrinkage S, 7.6 RPC with 1.4% finish, and an average 17.6% void content. A high elongation yarn for knitting was prepared in a coupled process likewise, and, characterized by 52.1% elongation, 2.1 g/d tenacity, 1.8 g/d $T_7$, 6.3% shrinkage S, 7.5 RPC with 1.5% finish. The drawn yarns had $ST_{max}$ values of 0.122 g/d at $T(ST_{max})$ values of about 120° C. to about 140° C. The high elongation yarn had a 25% higher denier spread, as did the corresponding yarn in Example XVIII, prepared by a split process.

EXAMPLE XX

Undrawn hollow filaments of the invention were drawn in a coupled process wherein the undrawn filaments formed by high speed melt spinning, as described hereinbefore, were then immediately drawn at a speed ($V_D$), (e.g., by mechanically drawing between two rolls driven at speeds $V_S$ and $V_D$, respectively, to provide a draw-ratio (DR) defined by the ratio of the roll speeds ($V_D/V_S$); and then interlaced, finish re-applied, and wound into a package. The spinning speed ($V_S$) is selected to provide an as-spun filament yarn of elongation-to-break ($E_B$) between about 40% and about 160%, preferably between 40% and 120%, and especially between about 40% to about 90%. The draw-ratio is selected such to provide a uniform drawn yarn with an elongation-to-break ($E_B$) about 15% to about 40% for homopolymers and about 15% to about 55% for modified polymers of low shrinkage, which provide for taper-draw, as described hereinbefore. To reduce the draw forces at the high draw speeds of the coupled spin/draw process of the invention, a steam draw jet, for example, may be used. The shrinkage of the drawn yarn is controlled to the desired level by heat treatment, for example, by multiple wraps around heated rolls. To achieve the required winding tension, the drawn yarn may be overfed to another set of rolls or overfed to the windup wherein the winding speed (VW) is equal to or slightly less than the draw speed (VD). As expected the homopolymer provided higher tensiles and lower shrinkage. For end-uses where ease of napping and cationic dyeable is required the lower tensiles of the drawn copolymer yarns are considered more desirable.

EXAMPLE XXI

In Example XXI nominal 170 and 120 denier 50-filament POY were prepared wherein the filaments are characterized by a hexalobal cross-section with a single void. The 170/50 POY are characterized by nominal elongation ($E_B$) of 116%, a $T_7$ of 0.53 g/d, a shrinkage S of about 50% and a 2.5 g/d tenacity. The 120/50 POY are characterized by a nominal elongation of 118%, a $T_7$ of 0.62 g/d and a shrinkage S of about 34% and a tenacity of about 2.6 g/d. The 120/50 POY were warp drawn at 500 mpm to a nominal 70 denier using a 1.7× draw-ratio at 90° C. and heat set temperature at 150° C. to provide drawn yarns of 18% elongation, 4.9 g/d tenacity, 68 g/d modulus, a shrinkage S of 5.8% and a dry heat shrinkage (DHS) of 8.4% with a S2-value of 2.6%. The void content was estimated to be about 8% based on total area, but based on the area of the circumscribed "round" filament (i.e., excluding the area of the "desired" lobes) the void content is about 12%. Decreasing the draw ratio to achieve higher drawn $E_B$-values of 25% (i.e., more typical of commercial drawn yarns), the void content is expected to increase to 18–20% which is similar to control round hollow filament yarns.

EXAMPLE XXII

The desirable objective of providing a multi-filament yarn of irregular cotton-like cross-section (i.e., similar to the 'opens' in FIG. 1A) is achieved by selecting process parameters that make complete post-coalescence difficult, that is, partial coalescence, of the melt streams to form the desired 'opens', as depicted in FIG. 1A, of the same denier as that of the hollow filaments. It is found that selecting orifice capillaries wherein (S+T) is less than 40 degrees (preferably less than 30 degrees) and that the product [(S/T)(L/W)] is close to unity (i.e., <1.25) where (S/T)=1 favors the formation of opens. Decreasing polymer temperature $T_P$ to less than ($T_M^o$+35) and use of short delay shroud (2 to 4 cm) favors formation of opens, but care in selection is required to prevent 'cold' fracture leading to complete non-coalescence and to broken filaments during attenuation.

Thus, a process for preparing cotton-like multi filament yarns is provided by selecting a polymer temperature between $T_P$=($T_M^o$+25) to ($T_M^o$+35) and using an extrusion die characterized by total entrance angle (S+T) less than 40 degrees (preferably less than about 30 degrees) with a [(S/T)(L/W)]-value less than 1.25 and using delay quench length of less than 5 cm; and selecting capillary flow rate w and withdrawal speed $V_S$ such that the product of (9000 w/$V_S$) and $[1.3/(RDR)_s]$ is between about 1 and 2, where $(RDR)_s$ is the residual draw-ratio of the spun undrawn filaments, defined hereinbefore by $(1+E_B/100)_s$.

EXAMPLE XXIII

Knit and woven fabrics were made from the flat and textured yarns of the invention and compared on an equal weight basis with similar fabrics made using "solid" filament flat and textured yarns and also made using staple yarns. The fabric testing showed that the hollow filament fabrics provided lighter weight per volume (higher fabric bulk) with increased heat retention but with increased moisture permeability, a desirable combination for improved comfort; especially in active wear. The textured hollow filament yarns were warmer than conventional staple hollow filaments produced by slow speed spin/draw processes and provided greater strength and pill resistance than the staple yarn fabrics. The hollow filament yarns also provide the inherent advantages of filament yarns versus staple yarns in end-use processing (e.g., higher speed knitting and weaving) and alternative tactile aesthetics from air-jet and false-twist texturing; and also "truly" flat fabrics which can not be achieved with staple fiber yarns with free-ends.

In a direct comparison of 3 dpf hollow filament and hollow staple fabrics (brushed double Jersey fabric), the fabric made from filament yarns (test) had an air permeability of 356 $ft^3/min/ft^2$ vs. a value of 274 for the staple fiber fabric (control). The wear resistance, as measured by the ASTM RTPT 30-minute test, was 35% greater for the test fabric vs. control fabric. The warmth (heat retention as measured by the clo-value) was about 20–25% greater for the test fabric vs. control. Both fabrics were equal in wicking behavior.

EXAMPLE XXIV

We consider three features are generally important when selecting dimensions for hollow filaments according to the invention for use in fabrics: 1) linear density (weight); 2) volume; and 3) rigidity (bending modulus); all three can affect the tactile aesthetics of fabrics made from hollow filament yarns. In considering simple variations in dimensions of hollow filaments, three simple generic cases are considered in FIGS. 12 and 13: 1) constant linear density (denier) as shown by lines a and a' in FIGS. 12 and 13; 2) constant volume as shown by lines b and b' in FIGS. 12 and 13; and 3) constant rigidity as shown by lines c and c' in FIGS. 12 and 13. For Case 1, the weight is kept constant even when the void content is increased (line a, FIG. 12), so as to increase the volume (peripheral diameter, line a') and this provides an increase in filament/fabric stiffness (like line a in FIG. 13) which can be used to increase the "drape" and "body" of a fabric. In Case 2, the volume (i.e., peripheral diameter) is kept constant (line c in FIG. 12) even as the void content is increased which results in a reduction in weight (line c' in FIG. 12) and rigidity (line c in FIG. 13). For inherently heavy fabric constructions this approach would be beneficial; however, for fabrics that are already of light weight, this approach may lead to a fabric of poor drape hand and "flimsy" tactile aesthetics. In Case 3 the rigidity is kept constant (line b in FIG. 13) with increasing void content by increasing filament volume (diameter, line b' in FIG. 12) with a reduction in weight (line b in FIG. 12). This approach is generally good for light weight fabrics when reduction in weight is acceptable, but where an increase in volume (bulk) will add warmth. Another route to obtaining constant fabric stiffness with increasing void content is to mix filaments of Cases 1 and 2, i.e., Case 3=(Case 1+Case 2)/2 in the most simple case. For fabric constructions for which reduction in weight and an increase in bulk is the goal where a slight stiffening is acceptable (or perhaps desired) then filaments of Cases 1 and 3 may be co-mingled. So the hollow filaments of this invention provide the fabric designer a large variety of options to meet the desiderata of fabric functionality and aesthetics, especially if the option of mixed-shrinkage is used, as discussed hereinbefore. Details on calculations of filament rigidity, weight, and volume as a function of void content are provided in an article: "The Mechanics of Tubular Fiber: Theoretical Analysis" Journal of Applied Science, Vol. 28, pages 3573–3584 (1983) by Dinesh K. Gupta. FIGS. 11–13 are BASED in part on information taken from Gupta's article.

To summarize the above discussion, as illustrated in FIGS. 12 and 13, as one increases void content, one can keep the weight constant or reduce the weight and/or increase the volume, while one can increase or decrease rigidity by appropriate selection of dpf and VC. In other words, by mixing dpf and VC, one can tailor aesthetics of fabrics as desired.

EXAMPLE XXV

In Example XXV the void content (% volume) is related to the "apparent work of extension" $(W_{ext})_a$ during attenuation. The phenomenological expression given hereinbefore for VC (%) as a function $(W_{ext})_a$ is:

$$VC(\%)=K_p Log_{10}\{k([LRV(T_M^o/T_p)^6][V_s^2(dpf)_s][EVA]^{1/2})^n\},$$

where the term in { } is referred herein as the apparent extension work of the attenuating hollow spinline $(W_{ext})_a$.

Figure 10:
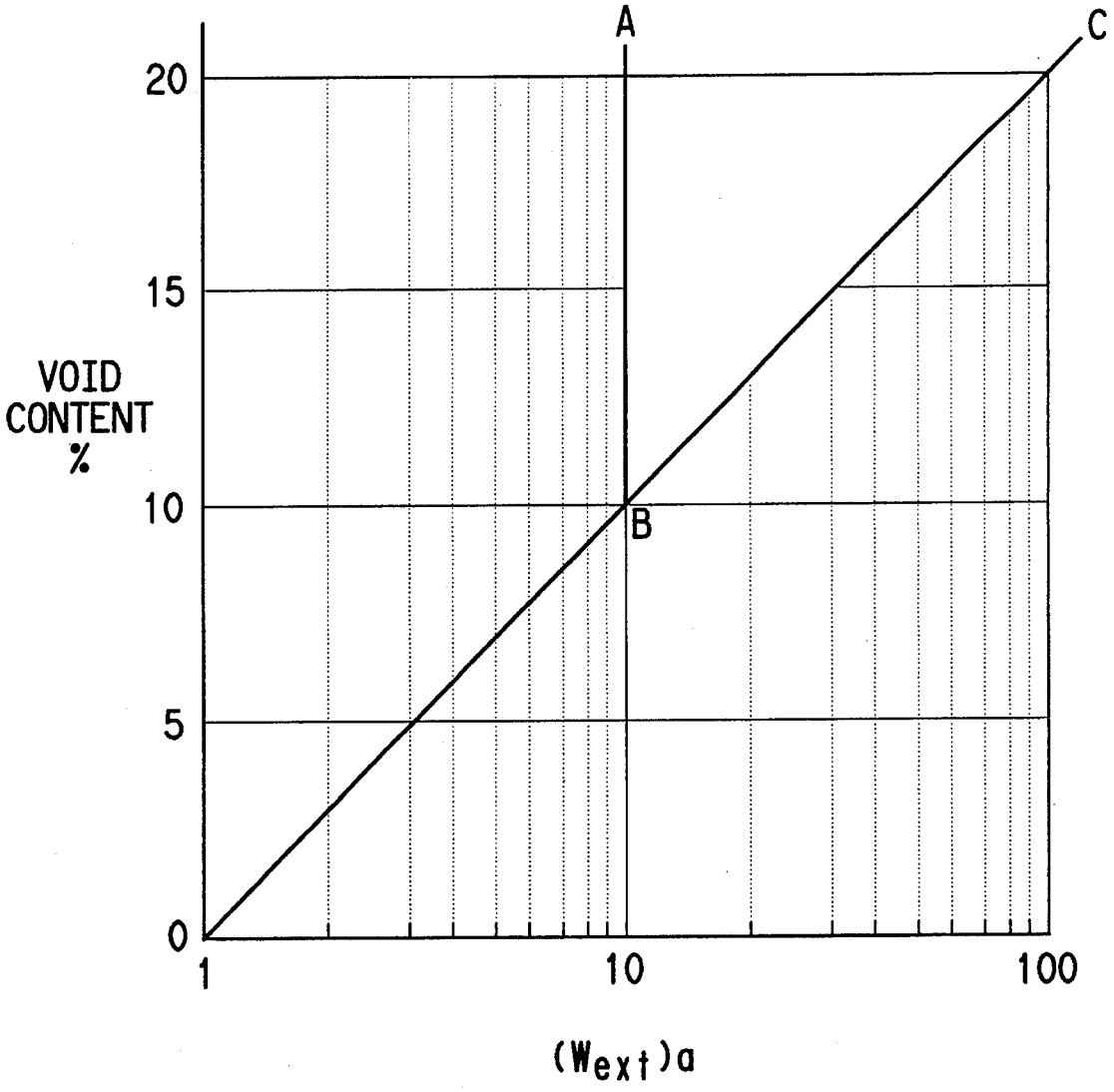
FIG. 10 is a semi-log partial plot of percent void content (VC) versus the apparent total extensional work $(W_{ext})_a$ plotted on a $Log_{10}$ scale, the latter being calculated as indicated hereinafter, to indicate preferred filaments of the invention having $(W_{ext})_a>10$, as well as VC>10%, as defined by open area ABC, it being understood that the lines BA and BC may both be extended beyond points A and C which are not limits. (For more detailed description of FIG. 10, refer to Example XXV).

For the most part, a fiber producer is not free to vary the filament denier since this is generally specified by a customer or fabric designer. In practice the product $[LRV(T_M^o/T_p)^6]$ is relatively constant for a selected polymer and melt spinning system. This leaves the fiber producer with $V_S$, EVA, and "n" as the primary process parameters for developing the desired balance of void content and tensiles. In FIG. 10 the extended line BC represents the expected increase in void content (VC) with segmented spinnerets. As dpf is reduced to meet new fashion needs and as polymers of lower LRV and $T_M^o$ (i.e., modified 2GT for improved dyeability, and pill resistance, for example) are used, it becomes more difficult to achieve complete coalescence and high void content as discussed hereinbefore. Increasing (S/T) from 1 to about 2 and/or increasing (L/W) from 1–1.5 to about 4 or greater increases the value of $(W_{ext})_a$ and the spun void content (VC). The product of (S/T) and (L/W) takes into account (in an approximate manner) the effect of the orifice capillary geometry on die-swell and subsequently on void content. The upper limit of (S/T) will depend on the given polymer viscoelastic nature and on the melt viscosity and in turn on spinning performance. Values less than about 3 are preferred and values between about 1.25 and 2 are especially preferred. Increasing the (L/W)-ratio will increase die swell, but ultimately the die swell will become independent of the (L/W)-ratio. For PET polymers the upper limit for affecting die swell is greater than about 4 and less than about 12, depending on the viscoelastic nature of the specific polyester and on the polymer melt viscosity (LRV and $T_P$). With the addition of (S/T) and (L/W)-ratios as "process parameters" the fiber producer has the capability to meet the needs of the customer, especially for fine hollow filaments of denier less than 2. The above expression for $(W_{ext})_a$ does not take into account the importance of the gap width between segment arcs, nor the geometry of any "toe" of the arc orifice as illustrated in FIG. 5B, nor the effect of quenching rate nor of capillary array. The expression herein for $(W_{ext})_a$ is not intended to be all encompassing, but rather a starting point for selection of process parameters for achieving the desired level of void content for a given polymer and filament dpf of the invention.

EXAMPLE XXVI

Nylon drawn and POY filaments may be used herein as companion filaments in mixed polyester hollow filament/ nylon filament yarns; wherein, the nylon filaments are selected based on their dimensional stability; that is, are selected to avoid or minimize any tendency to spontaneously elongate (grow) at moderate temperatures (referred to in degrees C.) e.g., over the temperature range of 40° to 135°, as measured by the dynamic length change (given by the difference between the lengths at 135° C. and at 40° C.), of less than 0 under a 5 mg/d load at a heating rate of 50/minute as described in Knox et al, U.S. Pat. No. 5,137,666 and is similar to a stability criterion ($TS_{140\ C}$- $TS_{90\ C}$) described by Adams in U.S. Pat. No. 3,994,121 (Col. 17 and 18). The nylon companion filaments may be fully or partially drawn cold or hot to elongations ($E_B$) greater than 30% to provide uniform filaments similar to that of low shrinkage polyester hollow filaments of the invention and thus provide for the capability of codrawing polyamide filaments/polyester hollow filaments. The low shrinkage undrawn hollow polyester filaments may be co-mingled with polyamide filaments and the mixed-filament bundle may be drawn cold or hot may be partially drawn to elongations ($E_B$) greater than 30% to provide uniform drawn filaments as low shrinkage polyester filaments, as described by Knox and Noe in U.S. Pat. No. 5,066,427, and thus provide for the capability of co-drawing polyamide/polyester undrawn hollow filaments. The polyamide/polyester hollow filaments may be drawn according to Example XIII to provide polyester hollow filaments of high shrinkage S and polyamide filaments with shrinkages in the range of about 6 to 10% as disclosed by Boles et al in W091/19839. In such processes wherein yarns are post heat treated to reduce shrinkage, such post heat treatments are preferably carried out at temperatures ($T_R$ in degrees C.) less than about the following expression: $T_R$ <(1000/[4.95–1.75$(RDR)_{D,N}$]–273), where $(RDR)_{D,N}$ is the calculated residual draw-ratio of the drawn nylon filaments, and is at least about 1.2 to provide for uniform dyeability of the nylon filaments with large molecule acid dyes as described by Boles et al in WO91/19839, published Dec. 26, 1991. Preferred polyamide filaments are described by Knox et al in U.S. Pat. No. 5,137,666.

TABLE I

| | 1C | 2C | 3C | 4C | 5C | 6C | 7C | 8C | 9 | 10 | 11 | 12 | 13C |
|---|---|---|---|---|---|---|---|---|---|---|---|---|---|
| SPIN SPEED, YPM | 2500 | 2500 | 2500 | 2500 | 2500 | 2500 | 3500 | 3500 | 3500 | 3500 | 3500 | 3500 | 3500 |
| SPIN SPEED, MPM | 2286 | 2286 | 2286 | 2286 | 2286 | 2286 | 3200 | 3200 | 3200 | 3200 | 3200 | 3200 | 3200 |
| POLYMER TYPE | HO | HO | HO | CO | CO | CO | HO | HO | HO | HO | HO | HO | CO |
| DPF | 5.0 | 3.4 | 2.4 | 5.0 | 3.4 | 2.4 | 5.0 | 3.4 | 3.4 | 2.4 | 2.0 | 1.6 | 5.0 |
| % VOID | 24.2 | 20.8 | 19.9 | 15.5 | 12.0 | 12.6 | 17.5 | 17.3 | 15.8 | 15.8 | 14.6 | 15.2 | 16.3 |
| MODULUS, G/D | 13.8 | 14.3 | 15.6 | 14.8 | 16.3 | 16.6 | 19.7 | 20.6 | 22.2 | 22.2 | 25.0 | 28.2 | 18.9 |
| T (7%), G/D | 0.43 | 0.44 | 0.47 | 0.48 | 0.51 | 0.54 | 0.53 | 0.56 | 0.59 | 0.59 | 0.70 | 0.74 | 0.61 |
| TENACITY, G/D | 2.18 | 2.35 | 2.49 | 1.35 | 1.35 | 1.34 | 2.52 | 2.79 | 2.90 | 2.90 | 2.83 | 2.85 | 1.57 |
| ELONGATION, % | 181.3 | 167.6 | 149.3 | 187.6 | 163.5 | 146.5 | 116.8 | 111.4 | 105.5 | 105.5 | 95.1 | 93.3 | 127.1 |
| Smax, % | 56.7 | 58.8 | 61.6 | 55.8 | 59.5 | 62.1 | 66.6 | 67.5 | 73.9 | 68.4 | 70.0 | 70.3 | 65.1 |
| S1, % | 56.9 | 56.3 | 53.1 | 54.4 | 59.0 | 51.6 | 65.5 | 58.9 | 34.0 | 22.6 | 13.7 | 7.9 | 55.3 |
| S1/Smax | 1.00 | 0.96 | 0.86 | 0.97 | 0.99 | 0.83 | 0.98 | 0.87 | 0.46 | 0.33 | 0.20 | 0.11 | 0.85 |
| STmax, MG/G | 32 | 34 | 43 | 32 | 33 | 42 | 53 | 58 | 62 | 62 | 70 | 75 | 53 |
| T(ST), °C. | 75 | 74 | 71 | 76 | 74 | 75 | 73 | 72 | 74 | 74 | 77 | 82 | 81 |

TABLE 2

| | 14C | 15 | 16 | 17 | 18 | 19 | 20 | 21 | 22 | 23 | 24 | 25 | 26 |
|---|---|---|---|---|---|---|---|---|---|---|---|---|---|
| SPIN SPEED, YPM | 3500 | 4500 | 4500 | 4500 | 4500 | 4500 | 4500 | 4500 | 4500 | 4500 | 4500 | 4500 | 5100 |
| SPIN SPEED, MPM | 3200 | 4115 | 4115 | 4115 | 4115 | 4115 | 4115 | 4115 | 4115 | 4115 | 4115 | 4115 | 4663 |
| POLYMER TYPE | CO | CO | HO | HO | HO | HO | HO | HO | HO | CO | CO | CO | CO |
| DPF | 3.4 | 2.4 | 5.0 | 3.4 | 3.0 | 2.4 | 2.4 | 2.1 | 1.8 | 5.0 | 3.4 | 2.4 | 2.4 |
| % VOID | 16.0 | 12.9 | 18.0 | 17.0 | 18.1 | 19.0 | 18.0 | 16.6 | 14.8 | 17.7 | 16.0 | 16.2 | 10.2 |
| MODULUS, G/D | 18.8 | 20.4 | 28.9 | 28.7 | 31.5 | 33.1 | 28.2 | 29.3 | 36.4 | 22.0 | 24.5 | 24.9 | 26.2 |
| T (7%), G/D | 0.66 | 0.73 | 0.76 | 0.81 | 0.82 | 0.93 | 0.83 | 1.06 | 0.98 | 0.77 | 0.81 | 0.89 | 0.96 |
| TENACITY, G/D | 1.56 | 1.61 | 3.05 | 3.18 | 2.90 | 2.83 | 2.97 | 2.90 | 3.25 | 1.73 | 1.70 | 1.68 | 1.86 |
| ELONGATION, % | 119.4 | 108.9 | 90.3 | 89.4 | 77.0 | 72.5 | 80.4 | 77.9 | 83.8 | 94.5 | 91.0 | 76.8 | 120.5 |
| Smax, % | 66.2 | 67.9 | 70.7 | 70.9 | 72.8 | 73.5 | 72.2 | 72.6 | 71.7 | 70.1 | 70.6 | 72.8 | 66.1 |
| S1, % | 53.9 | 48.3 | 12.2 | 5.4 | 4.4 | 3.3 | 4.2 | 3.7 | 3.7 | 32.0 | 28.6 | 21.9 | 12.8 |
| S1/Smax | 0.81 | 0.71 | 0.17 | 0.08 | 0.06 | 0.04 | 0.06 | 0.05 | 0.05 | 0.05 | 0.06 | 0.30 | 0.19 |
| STmax, MG/G | 57 | 56 | 69 | 65 | N/A | 69 | N/A | N/A | N/A | 76 | 70 | 75 | N/A |
| T(ST), °C. | 78 | 80 | 76 | 79 | N/A | 84 | N/A | N/A | N/A | 84 | 86 | 86 | N/A |

TABLE 3

| | 1C | 2C | 3 | 4 | 5 | 6 | 7 | 8 | 9 | 10 |
|---|---|---|---|---|---|---|---|---|---|---|
| SPEED, YPM | 3500 | 3500 | 3500 | 3500 | 3500 | 3500 | 3500 | 3500 | 3500 | 3500 |
| SPEED, MPM | 3200 | 3200 | 3200 | 3200 | 3200 | 3200 | 3200 | 3200 | 3200 | 3200 |
| POLYMER | HO | HO | HO | HO | HO | HO | HO | HO | HO | HO |
| CAP. OD | 50 | 60 | 70 | 50 | 60 | 70 | 50 | 60 | 70 | 50 |
| DPF | 5.0 | 5.0 | 5.0 | 3.4 | 3.4 | 3.4 | 2.4 | 2.4 | 2.4 | 5.0 |
| % VOID | 18.8 | 21.1 | 20.0 | 18.4 | 17.5 | 17.9 | 13.4 | 15.6 | 15.8 | 10.3 |

TABLE 3-continued

| | 1C | 2C | 3 | 4 | 5 | 6 | 7 | 8 | 9 | 10 |
|---|---|---|---|---|---|---|---|---|---|---|
| MOD., G/D | 18.6 | 18.8 | 19.1 | 19.5 | 21.3 | 21.5 | 21.8 | 22.1 | 23.8 | 18.0 |
| T (7%), G/D | 0.52 | 0.52 | 0.53 | 0.54 | 0.57 | 0.59 | 0.61 | 0.63 | 0.66 | 0.60 |
| TEN., G/D | 2.60 | 2.61 | 2.62 | 2.77 | 2.77 | 2.80 | 2.65 | 2.91 | 2.79 | 1.63 |
| Eb, % | 126.6 | 123.9 | 121.3 | 121.8 | 117.6 | 115.3 | 109.0 | 108.3 | 99.0 | 129.7 |
| Smax, % | 65.1 | 65.6 | 66.0 | 65.9 | 66.5 | 66.9 | 67.8 | 68.0 | 69.4 | 64.7 |
| S1, % | 52.3 | 50.9 | 48.2 | 38.3 | 36.4 | 29.3 | 35.6 | 20.6 | 13.6 | 58.8 |
| S1/Smax | 0.80 | 0.78 | 0.73 | 0.58 | 0.55 | 0.44 | 0.53 | 0.30 | 0.20 | 0.09 |

TABLE 4

| | 11C | 12 | 13C | 14C | 15 | 16 | 17 | 18 | 19 | 20 |
|---|---|---|---|---|---|---|---|---|---|---|
| SPEED, YPM | 3500 | 3500 | 3500 | 3500 | 3500 | 4500 | 4500 | 4500 | 4500 | 4500 |
| SPEED, MPM | 3200 | 3200 | 3200 | 3200 | 3200 | 4115 | 4115 | 4115 | 4115 | 4115 |
| POLYMER | CO | CO | CO | CO | CO | CO | CO | CO | CO | CO |
| CAP. OD | 60 | 70 | 50 | 60 | 70 | 50 | 60 | 70 | 50 | 60 |
| DPF | 5.0 | 5.0 | 3.4 | 3.4 | 3.4 | 5.0 | 5.0 | 5.0 | 3.4 | 3.4 |
| % VOID | 13.0 | 12.9 | 7.2 | 11.6 | 10.1 | 13.7 | 10.7 | 13.5 | 14.3 | 10.3 |
| MOD., G/D | 17.9 | 17.7 | 19.3 | 17.9 | 18.0 | 22.2 | 20.6 | 22.9 | 23.4 | 21.4 |
| T (7%), G/D | 0.58 | 0.60 | 0.64 | 0.62 | 0.66 | 0.74 | 0.75 | 0.79 | 0.81 | 0.78 |
| TEN., G/D | 1.54 | 1.57 | 1.54 | 1.51 | 1.57 | 1.74 | 1.68 | 1.62 | 1.76 | 1.68 |
| Eb, % | 120.5 | 123.2 | 108.9 | 114.5 | 118.8 | 91.9 | 83.6 | 80.3 | 90.6 | 80.1 |
| Smax, % | 66.1 | 65.7 | 67.9 | 67.0 | 66.3 | 70.5 | 71.8 | 72.3 | 70.7 | 72.3 |
| S1, % | 60.0 | 41.6 | 56.9 | 53.8 | 39.7 | 26.5 | 28.5 | 23.2 | 26.3 | 28.1 |
| S1/Smax | 0.91 | 0.63 | 0.84 | 0.80 | 0.60 | 0.38 | 0.40 | 0.32 | 0.37 | 0.39 |

TABLE 5

| | 1 | 2 | 3 | 4 | 5 | 6 |
|---|---|---|---|---|---|---|
| SPIN SPEED, YPM | 3500 | 3500 | 3500 | 3500 | 3500 | 3500 |
| SPIN SPEED, MPM | 3200 | 3200 | 3200 | 3200 | 3200 | 3200 |
| POLYMER TYPE | HO | HO | HO | HO | HO | HO |
| QUENCH | XF | XF | XF | RAD | RAD | RAD |
| DPF | 2.4 | 2.0 | 1.6 | 1.4 | 2.0 | 1.6 |
| % VOID | 13.8 | 13.3 | 12.0 | 15.8 | 14.6 | 15.2 |
| MODULUS, G/D | 20.8 | 21.6 | 22.5 | 22.2 | 25.0 | 28.2 |

TABLE 5-continued

| | 1 | 2 | 3 | 4 | 5 | 6 |
|---|---|---|---|---|---|---|
| T (7%), G/D | 0.56 | 0.57 | 0.61 | 0.59 | 0.70 | 0.74 |
| TENACITY, G/D | 2.65 | 2.73 | 2.75 | 2.90 | 2.83 | 2.85 |
| ELONGATION, % | 103.3 | 102.5 | 96.1 | 105.5 | 95.1 | 93.3 |
| Smax, % | 68.7 | 68.8 | 69.8 | 73.9 | 70.0 | 70.3 |
| S1, % | 48.8 | 43.0 | 28.6 | 34.0 | 13.7 | 7.9 |
| STmax, MG/G | 60 | 63 | 70 | 62 | 70 | 75 |
| T (ST), °C. | 71 | 71 | 71 | 74 | 77 | 82 |

TABLE 6

| | 1C | 2C | 3C | 4C | 5 | 6C | 7C | 8 | 9C | 10C | 11C | 12C | 13C | 14 | 15C | 16 | 17 |
|---|---|---|---|---|---|---|---|---|---|---|---|---|---|---|---|---|---|
| POLYMER | HO | HO | HO | CO | HO | HO | CO | HO | HO | HO | HO | HO | HO | CO | CO | HO | HO |
| UNDRAWN | | | | | | | | | | | | | | | | | |
| EB, % | 145.1 | 127.1 | 123.9 | 123.2 | 121.8 | 121.3 | 119.4 | 118.8 | 117.6 | 115.3 | 112.2 | 109.2 | 109.1 | 108.9 | 108.5 | 104.3 | 104.3 |
| Smax, % | 62.3 | 65.1 | 65.6 | 65.7 | 65.9 | 66.0 | 66.2 | 66.3 | 66.5 | 66.9 | 67.4 | 67.8 | 67.8 | 67.9 | 67.9 | 68.6 | 68.6 |
| S1, % | 57.6 | 55.3 | 50.9 | 41.5 | 38.3 | 48.2 | 53.9 | 39.6 | 36.4 | 29.3 | 65.5 | 58.9 | 13.6 | 48.3 | 50.3 | 34.0 | 34.0 |
| S1/Smax | 0.92 | 0.85 | 0.78 | 0.60 | 0.58 | 0.73 | 0.81 | 0.60 | 0.55 | 0.44 | 0.97 | 0.87 | 0.20 | 0.71 | 0.74 | 0.50 | 0.50 |
| VOID, % | 17.2 | 16.3 | 21.1 | 12.9 | 13.4 | 20.0 | 16.0 | 10.1 | 17.5 | 17.9 | 20.6 | 17.1 | 15.8 | 12.9 | 9.6 | 15.4 | 15.4 |
| DRAWN | | | | | | | | | | | | | | | | | |
| DP | 1.81 | 1.70 | 1.50 | 1.65 | 1.50 | 1.50 | 1.50 | 1.63 | 1.50 | 1.50 | 1.56 | 1.53 | 1.50 | 1.50 | 1.60 | 1.50 | 1.50 |
| M/MIN | 400 | 600 | 500 | 600 | 500 | 500 | 600 | 600 | 500 | 500 | 400 | 400 | 500 | 600 | 600 | 400 | 400 |
| T(1), °C. | OFF | OFF | OFF | OFF | OFF | OFF | OFF | OFF | OFF | OFF | OFF | OFF | OFF | OFF | OFF | OFF | OFF |
| T(2), °C. | OFF | OFF | 105 | OFF | 105 | 105 | OFF | OFF | 105 | 105 | OFF | OFF | 105 | OFF | OFF | OFF | OFF |
| T(3), °C. | 185 | 180 | 150 | 180 | 150 | 150 | 180 | 180 | 150 | 150 | 185 | 185 | 150 | 180 | 180 | 185 | 185 |
| Eb, % | 25.6 | 24.2 | 21.5 | 21.6 | 22.6 | 22.4 | 34.3 | 19.1 | 19.1 | 15.8 | 27.3 | 26.7 | 15.8 | 28.4 | 22.2 | 27.1 | 27.1 |
| S1, % | 4.8 | N/A | 9.4 | 6.0 | 10.3 | 9.4 | N/A | 8.3 | 9.6 | 10.4 | 7.2 | 5.4 | 9.6 | N/A | 5.9 | 5.2 | 5.2 |
| ST, MG/D | 350 | N/A | 451 | N/A | 509 | 506 | N/A | N/A | 610 | 590 | 266 | 392 | 541 | N/A | N/A | 375 | 375 |
| VOID, % | 12.9 | 14.3 | 18.7 | 12.3 | 14.5 | 16.4 | 15.4 | 11.8 | 14.4 | 17.1 | 17.5 | 15.9 | 12.1 | 12.9 | 9.3 | 16.1 | 16.1 |

TABLE 7

| | 18 | 19 | 20 | 21 | 22 | 23 | 24 | 25 | 26 | 27 | 28 | 29 | 30 | 31 | 32 | 33 | 34 |
|---|---|---|---|---|---|---|---|---|---|---|---|---|---|---|---|---|---|
| POLYMER | HO | CO | HO | CO | CO | CO | CO | CO | CO | CO | HO | HO | HO | HO | HO | HO | HO |
| UNDRAWN | | | | | | | | | | | | | | | | | |
| EB, % | 100.3 | 99.0 | 95.3 | 85.4 | 84.6 | 83.6 | 81.2 | 80.1 | 76.0 | 70.1 | 68.7 | 105.5 | 105.5 | 105.5 | 105.5 | 105.5 | 105.5 |
| Smax, % | 69.2 | 69.4 | 69.6 | 71.5 | 71.6 | 71.8 | 72.1 | 72.3 | 72.9 | 73.8 | 74.0 | 73.9 | 73.9 | 73.9 | 73.9 | 73.9 | 73.9 |
| S1, % | 13.7 | 35.6 | 7.9 | 25.1 | 25.5 | 28.5 | 23.9 | 28.1 | 12.8 | 12.1 | 3.4 | 34.0 | 34.0 | 34.0 | 34.0 | 34.0 | 34.0 |
| S1/Smax | 0.20 | 0.51 | 0.11 | 0.35 | 0.36 | 0.40 | 0.33 | 0.35 | 0.18 | 0.17 | 0.05 | 0.46 | 0.46 | 0.46 | 0.46 | 0.46 | 0.46 |
| VOID, % | 11.9 | 13.4 | 10.7 | 9.4 | 9.0 | 10.7 | 9.8 | 10.3 | 8.5 | 8.6 | 16.9 | 15.8 | 15.8 | 15.8 | 15.8 | 15.8 | 15.8 |
| DRAWN | | | | | | | | | | | | | | | | | |
| DP | 1.54 | 1.70 | 1.43 | 1.35 | 1.27 | 1.36 | 1.36 | 1.34 | 1.27 | 1.23 | 1.22 | 1.4 | 1.6 | 1.7 | 1.7 | 1.7 | 1.7 |
| M/MIN | 400 | 500 | 400 | 600 | 600 | 600 | 600 | 600 | 400 | 400 | 400 | 500 | 500 | 500 | 500 | 200 | 600 |
| T(1), °C. | OFF | 90 | OFF | OFF | OFF | OFF | OFF | OFF | OFF | OFF | OFF | 90 | 90 | 90 | 90 | 90 | 90 |
| T(2), °C. | OFF | 105 | OFF | OFF | OFF | OFF | OFF | OFF | OFF | OFF | OFF | 105 | 105 | 105 | 105 | 105 | 105 |
| T(3), °C. | 185 | 160 | 185 | 180 | 180 | 180 | 180 | 180 | 185 | 185 | 185 | 160 | 160 | 160 | 170 | 160 | 160 |
| Eb, % | 25.0 | 19.6 | 30.1 | 21.2 | 30.5 | 27.0 | 24.2 | 27.1 | 30.0 | 29.9 | 38.0 | 40.0 | 28.3 | 19.2 | 17.7 | 17.6 | 18.5 |
| S1, % | 4.7 | N/A | 4.7 | 7.4 | 7.7 | 4.8 | 6.8 | 12.6 | N/A | N/A | 7.0 | 6.7 | 6.8 | 7.6 | 6.8 | 5.5 | 7.9 |
| ST, MG/D | 323 | N/A | 352 | N/A | N/A | N/A | N/A | N/A | N/A | N/A | 341 | N/A | N/A | N/A | N/A | N/A | N/A |
| VOID, % | 13.9 | 14.5 | 13.2 | 11.3 | 11.8 | 12.8 | 13.4 | 11.4 | 10.5 | 14.3 | 16.4 | 20.9 | 21.4 | 18.8 | 19.4 | 19.6 | 16.4 |

TABLE 8

| Feed Denier | Draw Ratio | Draw Temp (C.) | Over Feed % | Set Temp (C.) | Drawn Denier | Mod G/D | T7 G/D | T20 G/D | Ten G/d | Eb, % | Tb, G/D | S1, % |
|---|---|---|---|---|---|---|---|---|---|---|---|---|
| 127 | 1.4 | 25 | 16 | 25 | 104.5 | 23.9 | 1.05 | 1.95 | 2.57 | 37.5 | 3.53 | 21.2 |
| 127 | 1.4 | 25 | 16 | 180 | 110.8 | 46.3 | 0.97 | 1.83 | 2.26 | 31.0 | 2.96 | 1.4 |
| 127 | 1.4 | 115 | 16 | 25 | 103.8 | 20.0 | 1.19 | 2.19 | 2.64 | 32.6 | 3.50 | 7.8 |
| 127 | 1.4 | 115 | 16 | 180 | 108.2 | 36.2 | 1.10 | 2.07 | 2.58 | 33.5 | 3.44 | 1.6 |
| 127 | 1.4 | 180 | 16 | 25 | 103.8 | 18.9 | 1.27 | 2.44 | 2.54 | 22.3 | 3.11 | 3.8 |
| 127 | 1.4 | 180 | 16 | 180 | 104.2 | 37.7 | 1.42 | 2.43 | 2.74 | 27.5 | 3.49 | 1.9 |
| 159 | 1.6 | 25 | 16 | 25 | 116.3 | 28.0 | 1.06 | 1.84 | 2.66 | 37.2 | 3.65 | 40.3 |
| 159 | 1.6 | 25 | 16 | 180 | 138.1 | 34.3 | 0.76 | 1.23 | 2.37 | 49.6 | 3.55 | 1.7 |
| 159 | 1.6 | 115 | 16 | 25 | 114.4 | 21.1 | 1.27 | 2.37 | 2.66 | 26.0 | 3.35 | 8.7 |
| 159 | 1.6 | 115 | 16 | 180 | 120.6 | 29.8 | 0.94 | 2.07 | 2.76 | 34.0 | 3.70 | 1.9 |
| 159 | 1.6 | 180 | 16 | 25 | 114.4 | 18.4 | 1.23 | 2.63 | 2.91 | 24.8 | 3.63 | 4.4 |
| 159 | 1.6 | 180 | 16 | 180 | 115.1 | 24.7 | 1.24 | 2.58 | 2.85 | 24.7 | 3.55 | 2.6 |

We claim:

1. A polyester continuous hollow filament yarn, wherein said polyester is of LRV about 13 to 23 with a zero-shear melting point ($T_M^o$) of about 240° to 265° C., and a glass-transition temperature (Tg) of about 40° C. to 80° C., the hollow filaments are of denlet about 1 to about 5 and have one or more longitudinal voids with a void content (VC) comprising at least 10% of total filament volume, and said yarn is of elongation-to-break ($E_B$) about 40% to about 160%, tenacity-at-7% elongation ($T_7$) about 0.5 to 1.75 g/d, break tenacity $(T_B)_n$, normalized at 20.8 polymer LRV, of about 5 g/d or more, $(1-S/S_m)$ value of 0.4 or more, differential shrinkage (DHS-S) about +2% or less, where S is the boil-off shrinkage, $S_m$ is the maximum shrinkage potential and DHS is the dry heat shrinkage (measured at 180° C.), and peak shrinkage tension temperature $T(ST_{max})$ about 5° to about 30° C. greater than the polymer glass transition temperature $T_g$.

2. A yarn according to claim 1, wherein said yarn has an elongation-to-break ($E_B$) of about 90% to about 120%, a tenacity-at-7% elongation ($T_7$) of about 0.5 to about 1 g/d, and a $(1-S/S_m)$ value of about 0.4 or more.

3. A yarn according to claim 1, wherein said yarn has an elonganion-to-break ($E_B$) of about 40% to about 90%, a tenacity-at-7% elongation ($T_7$) of about 1 to about 1.75 g/d, and a $(1-S/S_m)$ value of about 0.85 or more.

4. A yarn according to claim 1, comprising two or more different filaments, wherein at least one filament has a shrinkage S such that the $(1-S/S_m)$ value is greater than 0.85, and at least another filament has a shrinkage S such that the $(1-S/S_m)$ value is in the range 0.4 to 0.85, where s is the boil-off shrinkage and $S_m$ is the maximum shrinkage potential, such that the shrinkage difference between these filaments is at least 5%

5. A polyester continuous hollow filament yarn, wherein said polyester is of LRV about 13 to 23 with a zero-shear melting point ($T_M^o$) of about 240° to 265° C., and a glass-transition temperature ($T_g$) of about 40° C. to 80° C., the hollow filaments are of denier about 1 to about 5 and have one or more longitudinal voids with a void content (VC) comprising at least 10% of total filament volume, and said yarn has an siongallon-to-break ($E_B$) of about 15 to 40%, a tenacity-at-7% elongation ($T_7$) of about 1 g/d or more, break tenacity $(T_B)_n$, normalized to 20.8 polymer LRV, of about 5 g/d or more, a post yield modulus ($M_{py}$) of about 5 to 25 g/d, and a $(1-S/S_m)$ value of about 0.85 or more, where S is the boil-off shrinkage and $S_m$ is the maximum shrinkage potential.

6. A yarn according to claim 5, having a relative disperse dye rate (RDDR), normalized to 1 dpf, of about 0.1 or more.

7. A yarn according to claim 5 or 6, wherein the polyester filaments are false twist-textured collapsed hollow filaments.

8. A polyester continuous hollow filament yarn, wherein said polyester is of LRV about 13 to 23 with a zero-shear melting point ($T_M^o$) of about 240° to 265° C., and a glass-transition temperature ($T_g$) of about 40° C. to 80° C., the hollow filaments are of denier about 1 to about 5 and have one or more longitudinal voids with a void content (vC) comprising at least 10W of total filament volume, and said yarn has an elongation-to-break ($E_B$) of about 15 to 40%, a tenacity-at-7% elongation ($T_7$) of about 1 g/d or more, break tenacity $(T_B)_n$, normalized to 20.8 polymer LRV, of about 5 g/d or more, a post yield modulus ($M_{py}$) of about 5 to 25 g/d, and a $(1-S/S_m)$-value of about 0.4 to about 0.85, where S is the boil-off shrinkage and $S_m$ is the maximum shrinkage potential.

9. A yarn according to any one of claims 1, 2, 3, 8 or 4, wherein the hollow filaments have a denier of about 1 to about 3, elongation-to-break ($E_B$) of about 40% to about 120%, and a $(1-S/S_m)$-value of about 0.6 or more.

10. A polyester continuous hollow filament yarn, wherein said polyester is of LRV about 13 to 23 with a zero-shear melting point ($T_M{}^o$) of about 240° to 265° C., and a glass-transition temperature ($T_g$) of about 40' C. to 80° C., the hollow filaments are of denier about 1 to about 5 and have one or more longitudinal voids with a void content (VC) comprising at least 10% of total filament volume, and said yarn has an elongation-to-break ($E_B$) of about 15 to 40%. a tenacity-at-7% elongation ($T_7$) of about 1 g/d or more, break tenacity $(T_B)_n$, normalized to 20.8 polymer LRV, of about 5 g/d or more, a post yield modulus ($M_{py}$) of about 5 to 25 g/d, said yarn being comprised of two or more different filaments, wherein at least one filament type has a shrinkage S such that the $(1-S/S_m)$-value is greater than 0.85, and at least another filament has a shrinkage S such that the $(1-S/S_m)$ value is in the range 0.4 to 0.85, where S is the boil-of shrinkage and $S_m$ is the maximum shrinkage potential, and wherein the difference between the shrinkages S of these filaments is at least

11. A yarn according to any one of claims 3, 5, 4, or 10, wherein the polyester filaments are air jet-textured and/or heat-relaxed filaments.

* * * * *